US010363751B2

(12) United States Patent
Horade

(10) Patent No.: US 10,363,751 B2
(45) Date of Patent: Jul. 30, 2019

(54) INKJET RECORDING APPARATUS CAPABLE OF PERFORMING INQUIRY PROCESS TO INQUIRE WHETHER INK HAS BEEN INJECTED INTO INK CHAMBER

(71) Applicant: BROTHER KOGYO KABUSHIKI KAISHA, Nagoya-shi, Aichi-ken (JP)

(72) Inventor: Kenta Horade, Tokai (JP)

(73) Assignee: BROTHER KOGYO KABUSHIKI KAISHA, Nagoya-shi, Aichi-Ken (JP)

( * ) Notice: Subject to any disclaimer, the term of this patent is extended or adjusted under 35 U.S.C. 154(b) by 0 days.

(21) Appl. No.: 15/875,073

(22) Filed: Jan. 19, 2018

(65) Prior Publication Data

US 2018/0207943 A1 Jul. 26, 2018

(30) Foreign Application Priority Data

Jan. 20, 2017 (JP) ..... 2017-008431

(51) Int. Cl.
*B41J 2/175* (2006.01)
*B41J 29/13* (2006.01)
*B41J 29/38* (2006.01)

(52) U.S. Cl.
CPC ..... *B41J 2/17566* (2013.01); *B41J 2/1752* (2013.01); *B41J 2/17509* (2013.01); (Continued)

(58) Field of Classification Search
CPC .... B41J 2/17566; B41J 2/17509; B41J 29/13; B41J 2/17513; B41J 29/38; B41J 2/17543; B41J 2/1752
See application file for complete search history.

(56) References Cited

U.S. PATENT DOCUMENTS

2010/0026741 A1 2/2010 Gold et al.
2016/0052288 A1 2/2016 Kondo et al.
(Continued)

FOREIGN PATENT DOCUMENTS

CN 102886988 A 1/2013
CN 103171307 A 6/2013
(Continued)

OTHER PUBLICATIONS

IP.com search (Year: 2019).*
(Continued)

*Primary Examiner* — Lisa Solomon
(74) *Attorney, Agent, or Firm* — Merchant & Gould P.C.

(57) ABSTRACT

An inkjet recording apparatus includes: a tank; a recording assembly; a cover; a memory; a display; an operation interface; and a controller. The controller performs: a first determination process to determine whether a quantity of ink in an ink chamber of the tank is less than a residual ink threshold; a second determination process to determine whether an exposing time of the cover is not less than a first time period; and an inquiry process to inquire whether ink has been injected into the ink chamber. The controller performs, based on the determination in the first determination process that the quantity of ink in the ink chamber is less than the residual ink threshold, the inquiry process without performing the second determination process; and performs, in response to receipt of a first operation in the inquiry process, an initialization process to initialize a count value for the ink chamber.

11 Claims, 8 Drawing Sheets

(52) U.S. Cl.
CPC ..... *B41J 2/17513* (2013.01); *B41J 2/17543* (2013.01); *B41J 29/13* (2013.01); *B41J 29/38* (2013.01)

(56) References Cited

U.S. PATENT DOCUMENTS

| | | | | |
|---|---|---|---|---|
| 2016/0059571 | A1* | 3/2016 | Kobayashi | B41J 2/17513 347/7 |
| 2016/0207337 | A1 | 7/2016 | Honoki et al. | |
| 2016/0207339 | A1 | 7/2016 | Honoki | |
| 2016/0303857 | A1 | 10/2016 | Genta et al. | |

FOREIGN PATENT DOCUMENTS

| | | | |
|---|---|---|---|
| CN | 105365395 | A | 3/2016 |
| CN | 105984231 | A | 10/2016 |
| CN | 106042648 | A | 10/2016 |
| JP | 2012-201101 | A | 10/2012 |
| JP | 2013-152685 | A | 8/2013 |
| JP | 2016-132218 | A | 7/2016 |
| JP | 2016-132220 | A | 7/2016 |
| JP | 2016-132221 | A | 7/2016 |
| WO | 2014/034109 | A1 | 3/2014 |

OTHER PUBLICATIONS

Related U.S. Appl. No. 15/874,980, filed Jan. 19, 2018.
Related U.S. Appl. No. 15/874,959, filed, Jan. 19, 2018.
Related U.S. Appl. No. 15/875,049, filed, Jan. 19, 2018.
Related U.S. Appl. No. 15/875,030, filed Jan. 19, 2018.
Office Action (Notice of Allowance) issued in related U.S. Appl. No. 15/875,030, dated Jan. 17, 2019.
InnovationQ Plus—IP.com search, Jan. 2, 2019, pp. 1-2.
Office Action (Notice of Allowance) issued in related U.S. Appl. No. 15/875,049, dated Jan. 23, 2019.
Office Action issued in related U.S. Appl. No. 15/875,049, dated Oct. 4, 2018.
Notification of First Office Action issued in related Chinese Patent Application No. 201810052718.3, dated Apr. 23, 2019.

* cited by examiner

INKJET RECORDING APPARATUS CAPABLE OF PERFORMING INQUIRY PROCESS TO INQUIRE WHETHER INK HAS BEEN INJECTED INTO INK CHAMBER

CROSS REFERENCE TO RELATED APPLICATION

This application claims priority from Japanese Patent Application No. 2017-008431 filed Jan. 20, 2017. The entire content of the priority application is incorporated herein by reference.

TECHNICAL FIELD

The present disclosure relates to an inkjet recording apparatus configured to record an image on a sheet.

BACKGROUND

Japanese patent application publication No. 2016-132221 describes one example of an inkjet recording apparatus provided with refillable ink tanks. A user injects ink from an ink bottle into an ink chamber of the ink tank through an inlet formed in the ink tank. The inkjet recording apparatus prompts the user to indicate whether the ink chamber has been refilled with ink when inferring that a refilling process has been performed. In response to the user operation to indicate that the ink chamber has been refilled, the inkjet recording apparatus initializes a count value indicative of a residual ink quantity.

SUMMARY

The inkjet recording apparatus infers that an ink chamber has been refilled with ink when the cover has remained in its exposing position for a length of time greater than a threshold value. After making such an inference, the inkjet recording apparatus performs an inquiry process to confirm with the user that an ink chamber has been refilled. However, if the user inadvertently performs an incorrect operation during the inquiry process to indicate that the ink chamber has not been refilled, even though the user has refilled the ink chamber with ink immediately before performing the inquiry process, the user would have to purposely reopen the cover for a sufficient length of time needed to trigger a repeat of the inquiry process. Consequently, the user may be greatly inconvenienced.

In view of the foregoing, it is an object of the disclosure to provide an inkjet recording apparatus capable of performing, at a more suitable timing, an inquiry process for prompting the user to confirm that an ink chamber has been refilled with ink.

The disclosure provides an inkjet recording apparatus including: a tank; a recording assembly; a cover; a memory; a display; an operation interface; and a controller. The controller performs: a first determination process to determine whether a quantity of ink in an ink chamber of the tank is less than a residual ink threshold; a second determination process to determine whether an exposing time of the cover is not less than a first time period; and an inquiry process to inquire whether ink has been injected into the ink chamber. The controller performs, based on the determination in the first determination process that the quantity of ink in the ink chamber is less than the residual ink threshold, the inquiry process without performing the second determination process; and performs, in response to receipt of a first operation in the inquiry process, an initialization process to initialize a count value for the ink chamber.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1A:
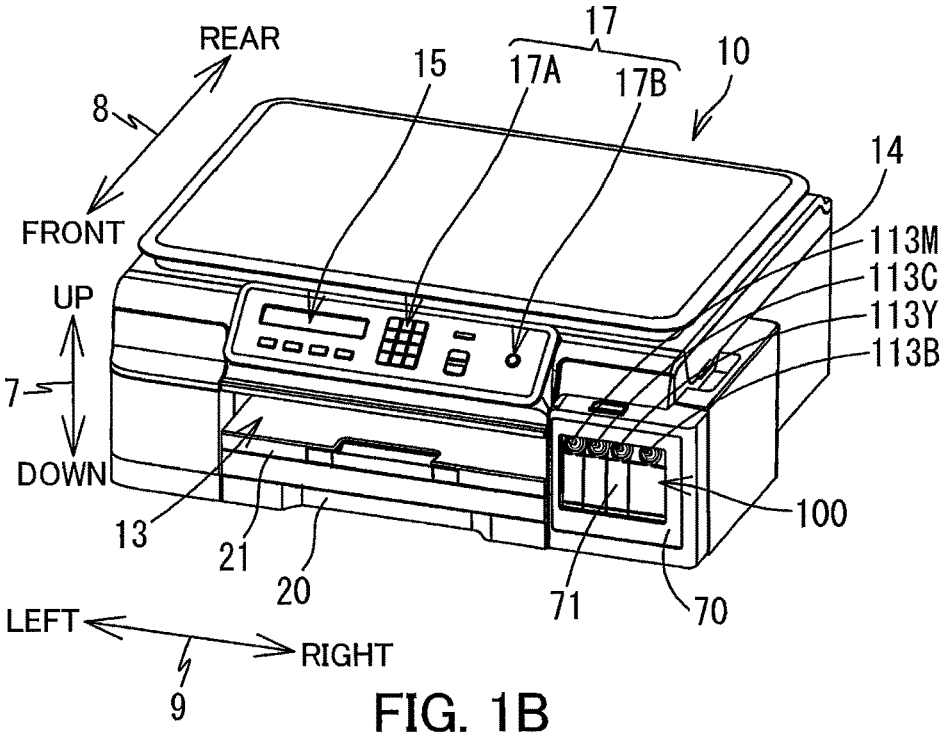
FIG. 1A is a perspective view of a multifunction peripheral (MFP) 10 in which a cover 70 of the MFP 10 is closed.

A multifunction peripheral (hereinafter abbreviated as "MFP") 10 as an example of an inkjet recording apparatus according to one embodiment will be described with reference to the accompanying drawings, wherein like parts and components are designated by the same reference numerals to avoid duplicating description.

Note that the embodiment described below is merely an example of the disclosure and may be modified in many ways without departing from the scope of the disclosure.

In the following description, an up-down direction 7 is defined based on an orientation of the MFP 10 when the MFP 10 is ready to use (hereinafter referred to as an "operable posture"); a front-rear direction 8 is defined so that a side of the MFP 10 in which a discharge opening 13 is formed is a front side; and a left-right direction 9 is defined based on a perspective of an user facing the front side of the MFP 10.

<Overall Structure of MFP 10>

As illustrated in FIGS. 1A, 1B, 2, and 5, the MFP 10 includes a feed tray 20, a discharge tray 21, a conveyor 23, a recording assembly 24, and an ink tank 100. The ink tank 100 is an example of a tank. These components of the MFP 10 are accommodated in a casing 14 having a general rectangular parallelepiped shape. The MFP 10 has a printer function for recording images on sheets according to an inkjet recording method. The MFP 10 may also have other functions, such as a facsimile function and a scanning function. The MFP 10 is an example of an inkjet recording apparatus.

<Feeding Tray 20 and Discharge Tray 21>

Figure 1B:
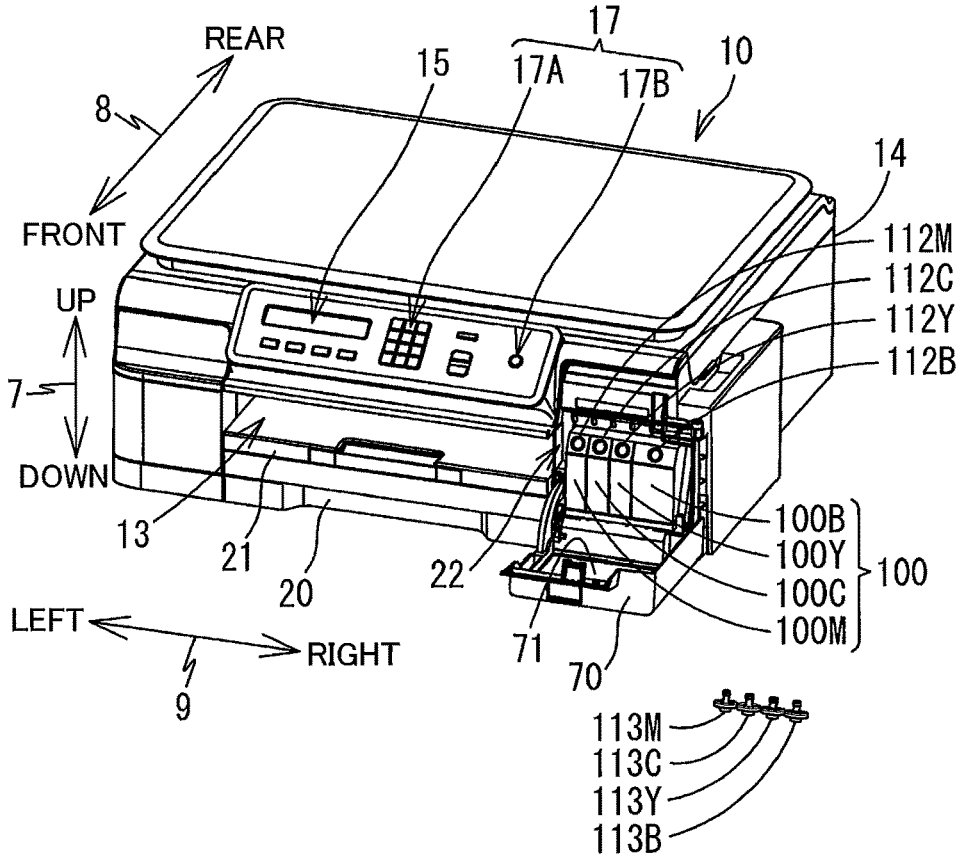
FIG. 1B is a perspective view of the MFP 10 in which the cover 70 is open.

As illustrated in FIGS. 1A and 1B, the discharge opening 13 is formed in a front surface of the casing 14 at its center region in the left-right direction 9. The feed tray 20 is inserted into and removed from the casing 14 through the discharge opening 13 in the front-rear direction 8. The feed tray 20 supports a plurality of sheets in a stacked state. The discharge tray 21 is positioned above the feed tray 20. The discharge tray 21 is inserted into and removed from the casing 14 together with the feed tray 20. The discharge tray 21 supports sheets discharged by the conveyor 23.

<Conveyor 23 and Recording Assembly 24>

The conveyor 23 conveys the sheets supported on the feed tray 20 along a conveying path that leads to the discharge tray 21 while passing through a position in which the sheets confront the recording assembly 24. The conveyor 23 includes a plurality of rollers and the like that rotate while in contact with the sheets, for example. The recording assembly 24 records images on sheets conveyed by the conveyor 23 by ejecting ink stored in the ink tank 100. The recording assembly 24 includes a carriage that is movable in a main scanning direction crossing a direction in which the sheets are conveyed, and a recording head that is mounted on the carriage and ejects ink through nozzles, for example.

Figure 2:
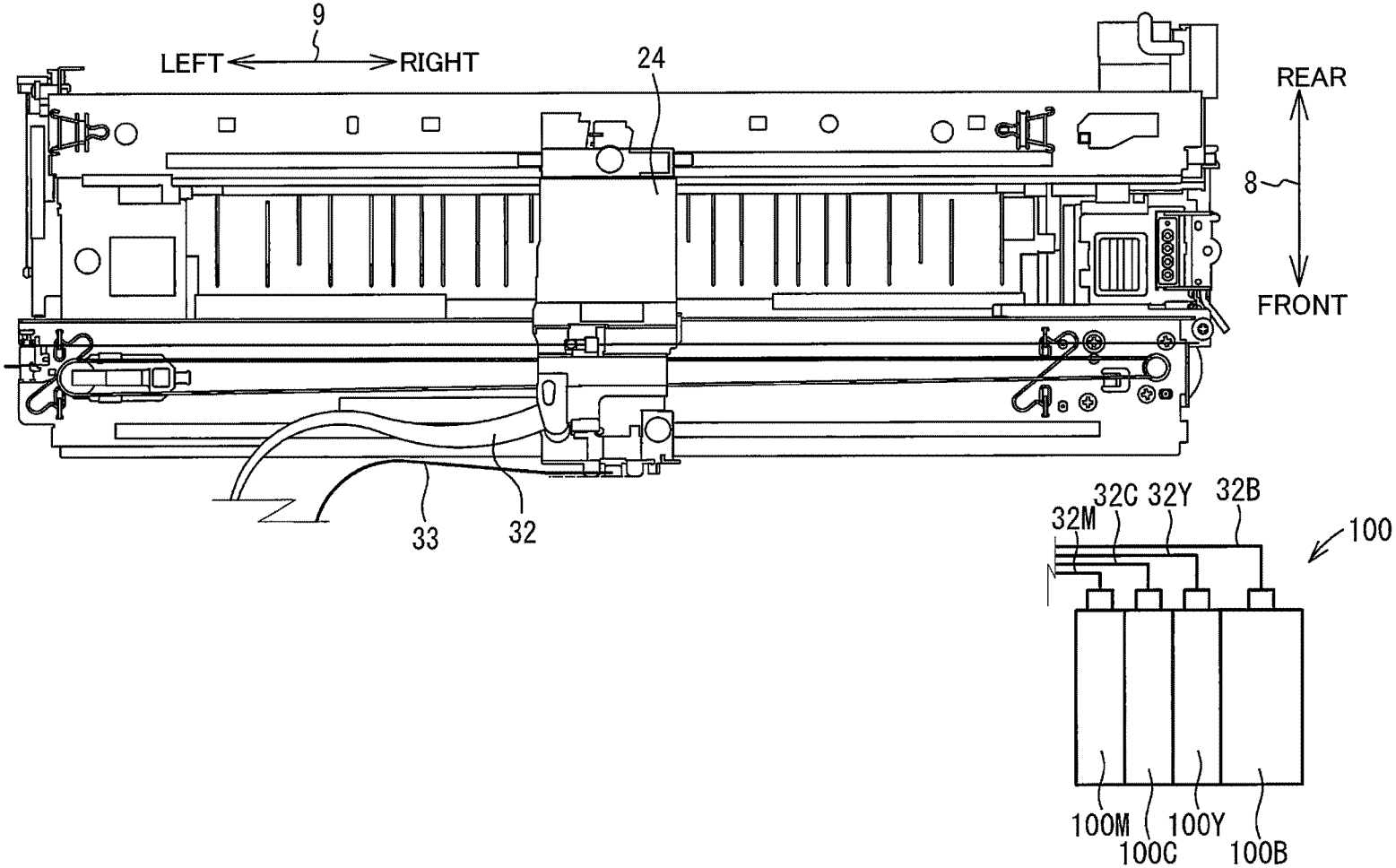
FIG. 2 is a plan view of a recording assembly 24 and an ink tank 100 of the MFP 10.

As illustrated in FIG. 2, ink tubes 32 and a flexible flat cable 33 are connected to the recording assembly 24. The ink tubes 32 supply ink stored in the ink tank 100 to the recording assembly 24. More specifically, the ink tubes 32 include four ink tubes 32B, 32Y, 32C, and 32M (hereinafter collectively referred to as the ink tubes 32) for allowing ink of four colors, i.e., black, magenta, cyan, and yellow, to flow therethrough, respectively. The ink tubes 32 are bundled together, with one end of the ink tubes 32 connected to and extending from the ink tank 100 and the other end connected to the recording assembly 24. More specifically, the one end of the ink tubes 32 is connected to ink chambers 111 (described later) of the ink tank 100 and the other end of the ink tubes 32 is connected to the recording head of the recording assembly 24. The flexible flat cable 33 transmits control signals outputted from a controller 130 (see FIG. 5) to the recording assembly 24. So, the recording assembly 24 (more specifically, the recording head) is electrically connected to the controller 130 through the flexible flat cable 33.

<Ink Tank 100>

As illustrated in FIGS. 1A and 1B, the ink tank 100 is positioned in an interior space of the casing 14 at its right-front portion. That is, the ink tank 100 is fixed in the MFP 10 and cannot easily be removed from the casing 14. Here, the phrase "cannot easily be removed" is intended to mean that a general user cannot simply remove the ink tank 100 from the MFP 10 under normal operating conditions, for example. There is no need to install the ink tank 100 in such a way that makes them impossible to remove from the MFP 10.

The ink tank 100 stores ink to be supplied to the recording assembly 24. The ink in the ink tank 100 is supplied to the recording head of the recording assembly 24. As illustrated in FIG. 1B, the ink tank 100 includes four tanks 100B, 100Y, 100C, and 100M. Each of the tanks 100B, 100Y, 100C, and 100M stores ink of a different color. Specifically, the tank 100B stores black ink, the tank 100Y stores yellow ink, the tank 100C stores cyan ink, and the tank 100M stores magenta ink. However, the number of tanks 100B, 100Y, 100C, and 100M and the colors of ink stored therein are not limited to the above example.

The four tanks 100B, 100Y, 100C, and 100M are positioned in a row along the left-right direction 9. Of the four tanks 100B, 100Y, 100C, and 100M, the tank 100B is positioned farthest to the right while the tank 100M is positioned farthest to the left. The tank 100B has a width in the left-right direction 9 greater than that of the other tanks 100Y, 100C, and 100M. The tank 100B also has an ink chamber 111B (described later) with a capacity greater than that of ink chambers 111Y, 111C, and 111M of the other tanks 100Y, 100C, and 100M. However, arrangement of the tanks 100B, 100Y, 100C, and 100M, sizes of the tanks 100B, 100Y, 100C, and 100M, and capacities of the ink chambers 111 are not limited to the relationships described in the above example.

Figure 3:
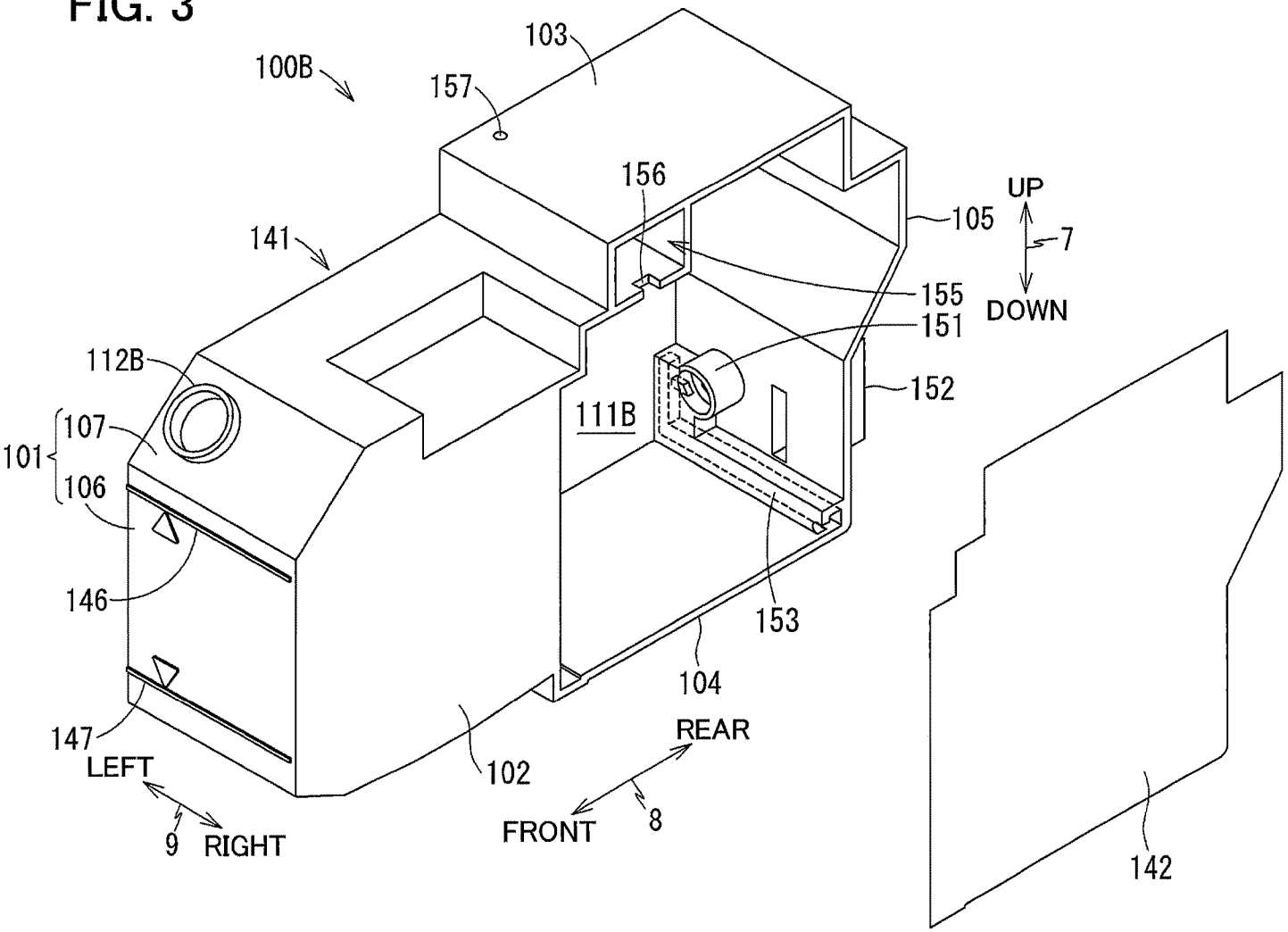
FIG. 3 is a perspective view of a tank 100B constituting the ink tank 100 as viewed from a front side thereof.
Figure 4:
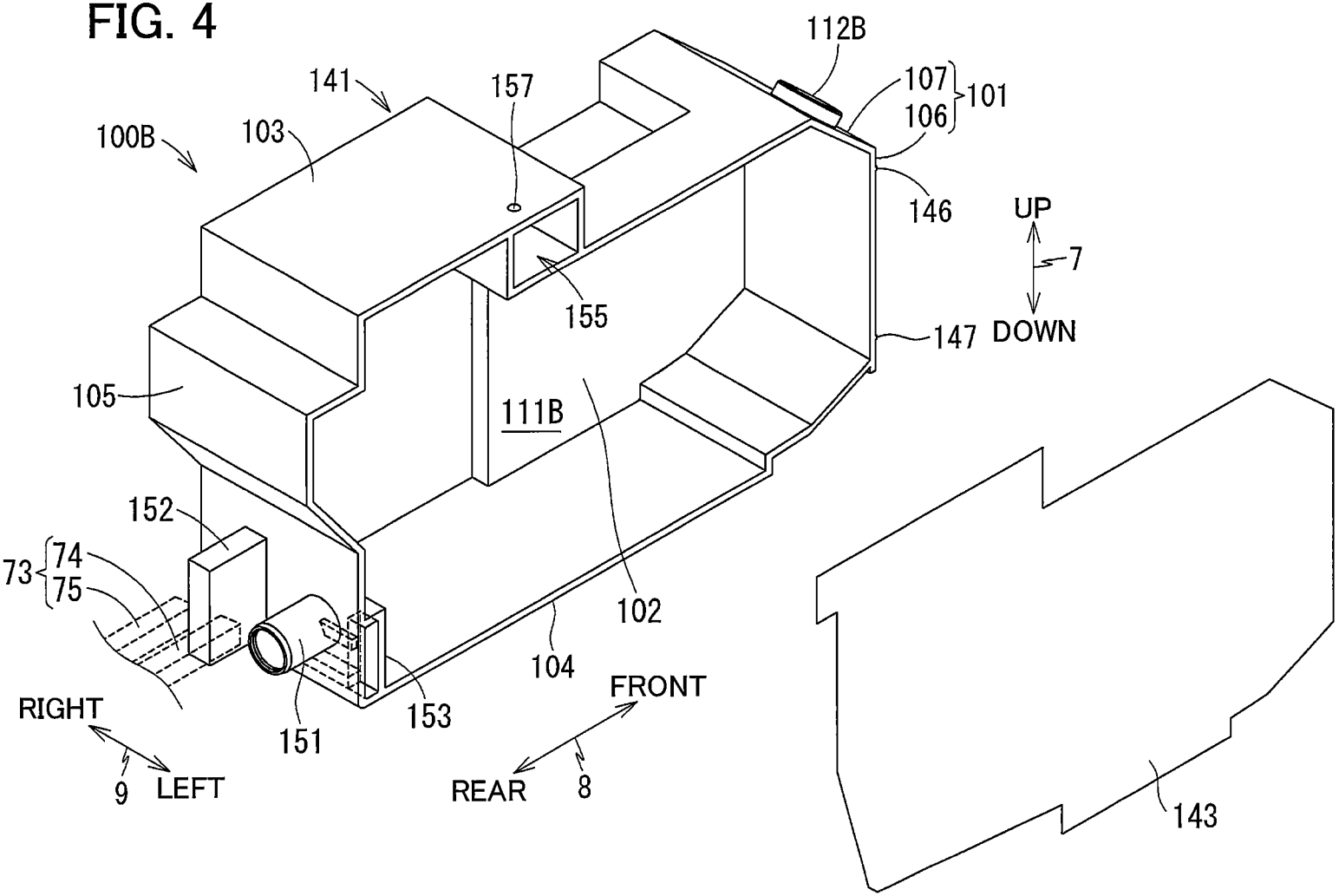
FIG. 4 is a perspective view of the tank 100B as viewed from a rear side thereof.

As illustrated in FIGS. 3 and 4, the tank 100B includes a frame 141, and two films 142 and 143. The frame 141 has a general rectangular parallelepiped shape that is flattened in the left-right direction 9 such that its dimensions in the up-down direction 7 and the front-rear direction 8 are greater than its dimension in the left-right direction 9. The frame 141 is formed of a resin (polypropylene, for example) that is sufficiently translucent to allow visual recognition of ink stored in the ink chamber 111B from outside the tank 100B. The frame 141 may be integrally molded through injection molding of a resin material, for example.

The frame 141 includes a front wall 101, a right wall 102, a top wall 103, a bottom wall 104, and a rear wall 105. A left end and part of a right end of the frame 141 are open. The films 142 and 143 are melt-bonded to the frame 141 so as to seal the openings in the left and right ends of the frame 141. The interior space of the tank 100B defined by the front wall 101, the right wall 102, the top wall 103, the bottom wall 104, the rear wall 105, and the films 142 and 143 constitutes the ink chamber 111B in which the ink is stored. Note that the ink chamber 111B may instead be defined by inner walls (not illustrated) positioned inside the outer walls 101-105 of the frame 141. Further, the ink chamber 111B may be divided into a plurality of small regions by partitioning walls (not illustrated).

The front wall 101 is configured of a vertical wall 106, and a sloped wall 107. The vertical wall 106 expands in the up-down direction 7 and the left-right direction 9. The sloped wall 107 is connected between a top edge of the vertical wall 106 and a front edge of the top wall 103. The sloped wall 107 slopes relative to the up-down direction 7 and the front-rear direction 8. An inlet 112B is formed in the sloped wall 107. Ink is injected, or poured, into the ink chamber 111B through the inlet 112B. The inlet 112B penetrates the sloped wall 107 in a thickness direction thereof, allowing the ink chamber 111B to be in communication with an exterior of the tank 100B.

The inlet 112B is closed with a cap 113B. In other words, the cap 113B partially is positioned in the inlet 112B and closes the inlet 112B. As illustrated in FIG. 1A, the cap 113B attached to the sloped wall 107 intimately contacts a surface of the sloped wall 107 defining a peripheral edge of the inlet 112B to seal the inlet 112B. As illustrated in FIG. 1B, on the other hand, the cap 113B is removed from the sloped wall 107 to open the inlet 112B. Here, the cap 113B can be attached to and removed from the sloped wall 107 while a cover 70 (described later) is in its exposing position. By removing the cap 113B from the inlet 112B, the user can inject ink into the ink chamber 111B through the inlet 112B.

As illustrated in FIGS. 3 and 4, a first line 146 and a second line 147 are on an outer surface of the vertical wall 106. The first line 146 and the second line 147 both extend in the left-right direction 9. When the MFP 10 is in its operable posture, the first line 146 is positioned approximately at a height in the up-down direction 7 the same as a level of ink in the ink chamber 111B when the ink chamber 111B stores ink of a preset maximum storage quantity. The maximum storage quantity corresponds to the quantity of ink stored in a single ink bottle (not illustrated), for example. When the MFP 10 is in its operable posture, the second line 147 is positioned lower in the up-down direction 7 than the first line 146 and higher in the up-down direction 7 than a detection position described later.

An ink supply port 151 is positioned at the rear wall 105. The ink supply port 151 has a cylindrical shape with a hollow interior space. The ink supply port 151 protrudes rearward from an outer surface of the rear wall 105. A distal end (i.e. protruding end) of the ink supply port 151 is open. The interior space of the ink supply port 151 is in communication with the ink chamber 111B through an ink channel 153 described later. By connecting the ink tube 32B to the ink supply port 151 so that one end portion of the ink tube 32B is fitted onto an outer surface of the ink supply port 151, ink stored in the ink chamber 111B is supplied to the ink tube 32B through the ink supply port 151.

An ink detection portion 152 is positioned at the rear wall 105. The ink detection portion 152 protrudes rearward from the outer surface of the rear wall 105. The ink detection portion 152 has a box shape with a hollow interior space. The ink detection portion 152 is formed of a light transmissive material that allows transmission of light irradiated from a light-emitter 74 described later. The interior space of the ink detection portion 152 is in communication with the ink chamber 111B. Hence, ink is present in the interior space of the ink detection portion 152 when the level of ink in the ink chamber 111B is higher than a lower edge of the ink detection portion 152. On the other hand, ink is not present in the interior space of the ink detection portion 152 when the level of ink in the ink chamber 111B is lower than the lower edge of the ink detection portion 152.

An ink channel 153 is a long narrow path for supplying ink stored in the ink chamber 111B to the ink supply port 151. The ink channel 153 has one end that communicates with the ink chamber 111B at a position in contact with an inner surface of the bottom wall 104, and the other end that communicates with the interior space of the ink supply port 151. More specifically, the ink channel 153 extends leftward from its communicating position with the ink chamber 111B, and then extends upward from the left end of the tank 100B, and lastly extends rightward from a position of height equal to the ink supply port 151 in order to communicate with the interior space of the ink supply port 151.

An air communication port 155 is also positioned in the tank 100B. The air communication port 155 is an air passage that allows the ink chamber 111B to communicate with external air. The air communication port 155 is higher in the up-down direction 7 than the inlet 112B. The air communication port 155 has one end that communicates with the ink chamber 111B through a notch 156 formed in a bottom wall of the air communication port 155, and the other end that communicates with an exterior of the tank 100B through a through-hole 157 penetrating the top wall 103. A labyrinth channel, a semipermeable membrane, or the like may be provided inside the air communication port 155.

<Residual Ink Sensor 73>

Figure 5:
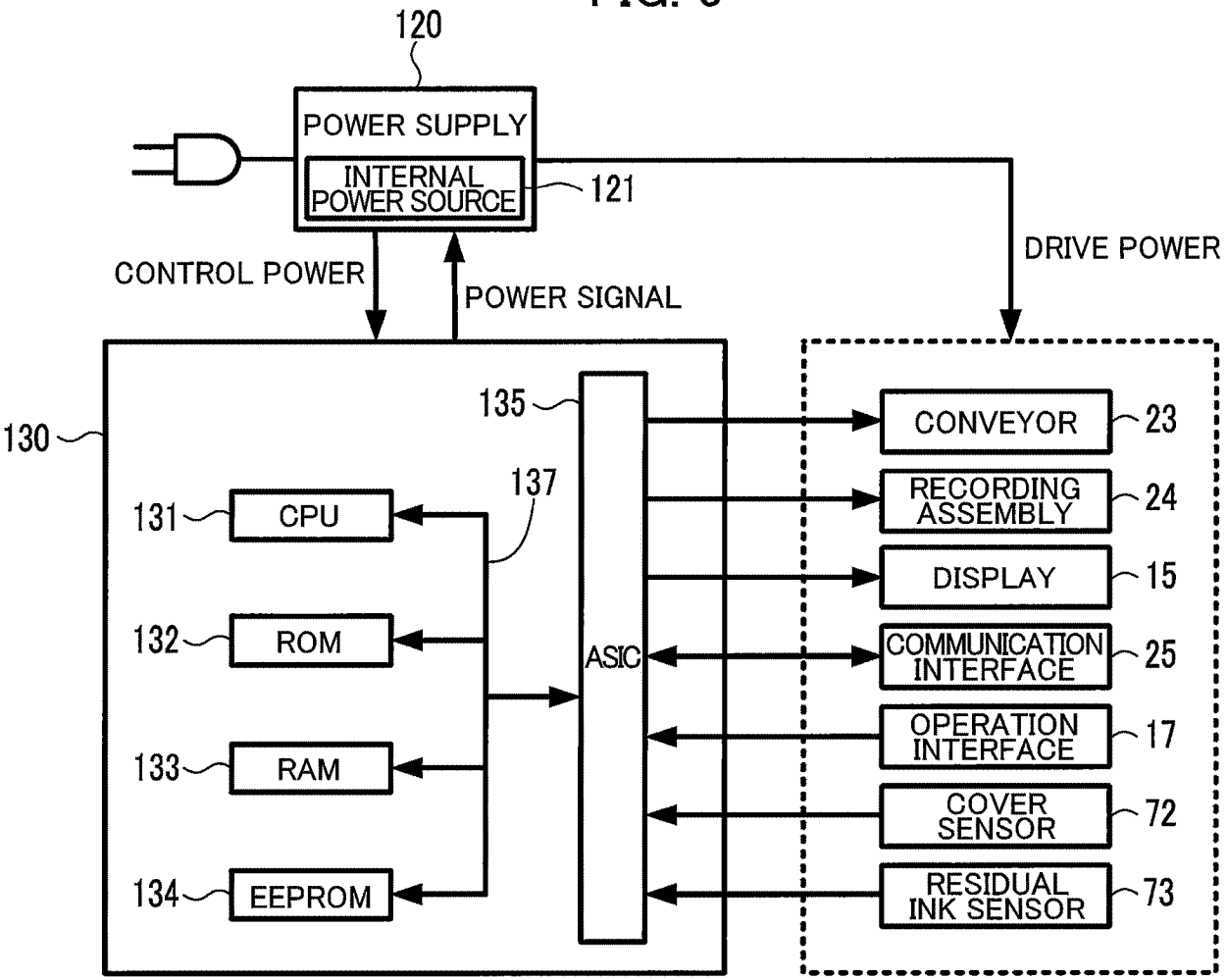
FIG. 5 is a functional block diagram of the MFP 10.

As illustrated in FIGS. 4 and 5, the MFP 10 also includes a residual ink sensor 73. The residual ink sensor 73 is electrically connected to the controller 130. The residual ink sensor 73 has the light-emitter 74 and a light-receiver 75. The light-emitter 74 and the light-receiver 75 are positioned on opposite sides of the ink detection portion 152 so as to face each other in the left-right direction 9. The light-emitter 74 irradiates light (visible light or infrared light, for example) toward the light-receiver 75. The light can pass through walls constituting the ink detection portion 152 but not through black ink. The light-receiver 75 outputs a residual ink signal to the controller 130 based on whether the light-receiver 75 has received light irradiated from the light-emitter 74 after the light passes through the ink detection portion 152. In other words, the residual ink sensor 73 outputs a residual ink signal to the controller 130 responsive to the quantity of ink stored in the ink chamber 111B.

The residual ink sensor 73 outputs either a first residual ink signal or a second residual ink signal to the controller 130. The residual ink sensor 73 outputs the first residual ink signal in response to presence of ink at the detection position in the ink detection portion 152. On the other hand, the residual ink sensor 73 outputs the second residual ink signal in response to non-presence of ink at the detection position in the ink detection portion 152. The first residual ink signal outputted from the residual ink sensor 73 has a signal level of 0 V, while the second residual ink signal outputted from the residual ink sensor 73 has a signal level of 3.3 V. Hence, the phrase "the residual ink sensor 73 outputs a residual ink signal" includes cases in which the signal level is 0 V. However, combination of signal levels is not limited to the above example. Combination of position signals of a cover sensor 72 (described later) is also not limited to the example in the present disclosure.

The detection position is a position within the interior space of the ink detection portion 152 having a height in the up-down direction 7 the same as those of the light-emitter 74 and the light-receiver 75. The detection position in the up-down direction 7 is lower than the second line 147 and slightly higher than the interior space of the ink supply port 151 when the MFP 10 is in its operable posture. Hence, the interior space of the ink supply port 151 is filled with ink when the level of ink in the ink chamber 111B is aligned with the detection position. However, when the level of ink in the ink chamber 111B drops below the detection position, air introduced into the ink chamber 111B through the air communication port 155 may enter the interior space of the ink supply port 151. A difference in the up-down direction 7 between the detection position and the interior space in the ink supply port 151 is preliminarily set based on an estimated quantity of ink required for recording an image on one sheet, for example.

Hence, the residual ink signal outputted from the residual ink sensor 73 switches from the first residual ink signal to the second residual ink signal at a timing in which the level of ink in the ink chamber 111B drops below the detection position. In the following description, a state of the ink chamber 111B when the residual ink sensor 73 outputs the second residual ink signal will be referred to as a "hard-empty" state. In other words, the term "hard-empty state" indicates a state of the ink chamber 111B just prior to air entering the interior space of the ink supply port 151, for example. "Hard-empty" is an example of the quantity of ink stored in the ink chamber 111B being less than a residual ink threshold. The residual ink threshold corresponds to the quantity of ink stored in the ink chamber 111B when the level of ink in the ink chamber 111B is at the detection position, for example.

The tanks 100Y, 100C, and 100M may have a basic structure the same as that of the tank 100B. However, the tanks 100Y, 100C, and 100M do not have the ink detection portion 152. That is, the controller 130 cannot detect residual ink quantities in the corresponding ink chambers 111Y, 111C, and 111M using residual ink sensors 73. Hereinafter, the ink chambers 111B, 111Y, 111C, and 111M will be collectively referred to as the "ink chambers 111," the inlets 112B, 112Y, 112C, and 112M will be collectively referred to as the "inlets 112," and the caps 113B, 113Y, 113C, and 113M will be collectively referred to as the "caps 113."

<Cover 70>

As illustrated in FIG. 1B, an opening 22 is formed in the front surface of the casing 14 at a right end thereof. The front surface of the ink tank 100 is exposed to an outside of the MFP 10 through the opening 22. The MFP 10 has a cover 70 that is pivotally movable between a covering position (a position illustrated in FIG. 1A) for covering the opening 22, and an exposing position (a position illustrated in FIG. 1B) for exposing the opening 22. The cover 70 is supported to the casing 14 at a bottom edge portion of the casing 14 so as to be pivotally movable about a pivot axis extending along the left-right direction 9.

In the covering position, the cover 70 covers all of the inlets 112B, 112Y, 112C, and 112M and restricts injection of ink into all of the ink chambers 111B, 111Y, 111C, and 111M through the inlets 112B, 112Y, 112C, and 112M. Here, the cover 70 in the covering position may cover the inlets 112 in their entirety or to cover just a portion of the inlets 112. When the cover 70 is in the exposing position, all of the inlets 112B, 112Y, 112C, and 112M are exposed outside the MFP 10, allowing ink to be injected into all of the ink chambers 111B, 111Y, 111C, and 111M.

The user performs the following series of steps for refilling the ink chambers 111 with ink. First, the user moves the cover 70 from the covering position to the exposing position and removes the cap 113 from the inlet 112 corresponding to the color of ink to be refilled. Next, the user inserts a tip of the ink bottle into the opened inlet 112 and injects all of ink in the ink bottle into the ink chamber 111. After the ink chamber 111 has been refilled, the user reattaches the cap 113 to the corresponding inlet 112 and moves the cover 70 back to the covering position.

The cover 70 has a transparent window 71. The transparent window 71 confronts the front walls 101 of the tanks 100B, 100Y, 100C, and 100M when the cover 70 is in the covering position. With this configuration, the user can visually recognize the residual ink quantity of ink in the ink chambers 111 through the front walls 101, regardless of whether the cover 70 is in the covering position or the exposing position. On the other hand, the transparent window 71 may be omitted from the cover 70. In this case, the user must move the cover 70 to the exposing position in order to check the levels of ink in the ink chambers 111.

<Cover Sensor 72>

As illustrated in FIG. 5, the MFP 10 also includes a cover sensor 72. The cover sensor 72 is electrically connected to the controller 130. The cover sensor 72 may be a mechanical sensor, such as a switch that the cover 70 contacts and separates from, or an optical sensor for emitting light that is transmitted or interrupted depending on the position of the cover 70, for example. The cover sensor 72 outputs, to the controller 130, a position signal responsive to the position of the cover 70.

The cover sensor 72 outputs either a first position signal or a second position signal to the controller 130. The first position signal is outputted from the cover sensor 72 in response to the cover 70 being in the covering position. The second position signal is outputted from the cover sensor 72 in response to the cover 70 being in a position other than the covering position (the exposing position, for example). The first position signal outputted from the cover sensor 72 has a signal level of 0 V, and the second position signal outputted from the cover sensor 72 has a signal level of 3.3. V. In the following description, an expression "cover open event" will be used to in response to that the position signal outputted from the cover sensor 72 has changed from the first position signal to the second position signal. An expression "cover close event" will be used to in response to that the position signal outputted from the cover sensor 72 has changed from the second position signal to the first position signal.

<Display 15>

As illustrated in FIGS. 1A, 1B and 5, the MFP 10 also includes a display 15. The display 15 is electrically connected to the controller 130. The display 15 displays information for the user in the form of messages. While there are no particular limitations on the specific structure of the display 15, a liquid crystal display or an organic electroluminescence display may be employed as the display 15, for example.

The display 15 has a rectangular shape with 8 dots vertically by 80 dots horizontally. Thus, the display 15 can display a maximum of 16 characters (including spaces), each comprising 8 dots vertically by 5 dots horizontally (approximately 8 mm vertically by approximately 5 mm horizontally). Further, when attempting to display a character string exceeding 16 characters on the display 15, the character string is displayed in a scrolling format. When attempting to display character strings in a plurality of lines on the display 15, the character string for each line is displayed in sequence. However, the size of the display 15 is not limited to the above example.

<Operation Interface 17>

The MFP 10 also includes an operation interface 17 for receiving user operations. The operation interface 17 is electrically connected to the controller 130. The operation interface 17 is an input interface that accepts input from a user indicating instructions for the MFP 10. The operation interface 17 is configured of a plurality of push buttons, including numeric keypad 17A and a power button 17B. However, the push buttons in the operation interface 17 are not limited to the above example, and may include directional keys corresponding to "up", "down", "right", and "left". Further, the specific configuration of the operation interface 17 is not limited to the push buttons, but may be a touchscreen superimposed over the display screen of the display 15.

The operation interface 17 outputs, to the controller 130, operation signals responsive to the push buttons that is pressed. Specifically, the operation interface 17 outputs a first operation signal, a second operation signal, or a third operation signal to the controller 130. The operation interface 17 outputs the first operation signal to the controller 130 when the [1] button in the numeric keypad 17A is pressed. The operation interface 17 outputs the second operation signal to the controller 130 when the [2] button in the numeric keypad 17A is pressed. The operation interface 17 outputs the third operation signal to the controller 130 when the power button 17B is pressed. The operation interface 17 also outputs, to the controller 130, other operation signals corresponding to other buttons when the other buttons are pressed.

In the following description, an expression "the [1] button is pressed" will indicate that the operation interface 17 outputs the first operation signal. An expression "the [2] button is pressed" will indicate that the operation interface 17 outputs the second operation signal. And an expression "the power button 17B is pressed" will indicate that the operation interface 17 outputs the third operation signal. Note that the buttons corresponding to the first operation signal, the second operation signal, and the third operation signal are not limited to the above example.

<Communication Interface 25>

As illustrated in FIG. 5, the MFP 10 also includes a communication interface 25. The communication interface 25 is electrically connected to the controller 130. The communication interface 25 is an interface through which the MFP 10 communicates with external devices. In other words, the MFP 10 transmits various data to external devices through the communication interface 25 and to receive various data from external devices through the communication interface 25. The communication interface 25 may also function as a facsimile receiver that receives facsimile data from external devices.

<Power Supply 120>

The MFP 10 also includes a power supply 120. The power supply 120 is electrically connected to the controller 130. The power supply 120 receives electric power from an external power source when the MFP 10 is plugged into the external power source, and supplies this electric power to various components in the MFP 10. More specifically, through the electric power acquired from the external power source, the power supply 120 outputs drive power (24 V, for example) to the conveyor 23, the recording assembly 24, and the like and outputs control power (5 V, for example) to the controller 130. The power supply 120 includes an internal power source 121. The power supply 120 charges the internal power source 121 with part of the electric power supplied from the external power source.

The power supply 120 can switch between a plug ON state and a plug OFF state. In the plug ON state, the MFP 10 is plugged into the external power source, and the MFP 10 receives electric power from the external power source through the plug. In the plug OFF state, the MFP 10 is unplugged, and the power supply 120 does not receive electric power from the external power source. Hence, the power supply 120 charges the internal power source 121 with some of the electric power supplied from the external power source during the plug ON state, but does not charge the internal power source 121 during the plug OFF state.

The power supply 120 in the plug ON state can switch between a switch ON state and a switch OFF state based on a power signal outputted from the controller 130. While the power supply 120 is in the switch OFF state, the controller 130 switches the power supply 120 to the switch ON state when the power button 17B is pressed. Similarly, while the power supply 120 is in the switch ON state, the controller 130 switches the power supply 120 to the switch OFF state when the power button 17B is pressed.

In the switch OFF state, the power supply 120 still supplies electric power to the controller 130 and the operation interface 17, but does not supply electric power to the conveyor 23, the recording assembly 24, the display 15, and the communication interface 25. In other words, the controller 130 and the operation interface 17 can still operate during the switch OFF state, but the conveyor 23, the recording assembly 24, the display 15, and the communication interface 25 are inoperable during the switch OFF state. In the switch OFF state, electric power may or may not be supplied to the cover sensor 72 and the residual ink sensor 73. During the switch ON state, electric power is supplied to the greater number of components of the MFP 10 than during the switch OFF state.

During the switch ON state, the power supply 120 can switch between a drive state and an idle state based on a power signal outputted from the controller 130. The controller 130 switches the power supply 120 from the idle state to the drive state when an operation is performed on the operation interface 17 or when the controller 130 receives information through the communication interface 25. The controller 130 switches the power supply 120 from the drive state to the idle state when the operation interface 17 has not been operated and the controller 130 has not received information through the communication interface 25 for a prescribed time interval.

In the drive state, the power supply 120 supplies electric power to all of the components in the MFP 10. In other words, all of the components in the MFP 10 are operable in the drive state. In the idle state, the power supply 120 supplies electric power to the controller 130, the operation interface 17, the communication interface 25, the cover sensor 72, and the residual ink sensor 73, but does not supply electric power to the display 15, the conveyor 23, and the recording assembly 24. Hence, the controller 130, the operation interface 17, the communication interface 25, the cover sensor 72, and the residual ink sensor 73 are operable in the idle state, but the conveyor 23, the recording assembly 24, and the display 15 are inoperable in the idle state.

<Controller 130>

As illustrated in FIG. 5, the controller 130 includes a central processing unit (CPU) 131, a read-only memory (ROM) 132, a random-access memory (RAM) 133, an electrically erasable programmable ROM (EEPROM) 134, and an application-specific integrated circuit (ASIC) 135. The CPU 131, the ROM 132, the RAM 133, the EEPROM 134, and the ASIC 135 are interconnected with one another via an internal bus 137. The ROM 132 stores programs and the like with which the CPU 131 controls various operations. The RAM 133 is a storage area for temporarily storing data, signals, and the like used when the CPU 131 executes the above programs, or as a work area for data processes. The EEPROM 134 stores settings, flags, and the like that must be preserved even during the plug OFF state. The ROM 132, the RAM 133, and the EEPROM 134 are examples of a memory.

The EEPROM 134 stores a count value for each of the ink chambers 111B, 111Y, 111C, and 111M. The count value is set to an initial value (0, for example) in S36 (described later) and is incremented in S46 (described later) based on the quantity of ink ejected from the recording assembly 24. In the following description, the count value for the ink chamber 111B will be referred to as the "count value B," the count value for the ink chamber 111Y will be referred to as the "count value Y," the count value for the ink chamber 111C will be referred to as the "count value C," and the count value for the ink chamber 111M will be referred to as the "count value M."

The EEPROM 134 also stores a first threshold value and a second threshold value for each of the ink chambers 111B, 111Y, 111C, and 111M. The first threshold value is set to a slightly smaller value (95, for example) than the maximum storage quantity (100, for example) of ink that can be stored in the corresponding ink chamber 111, for example. A difference between the maximum storage quantity and the first threshold value for the ink chamber 111B is equivalent to the residual ink threshold, for example. The second threshold value is set to a value (85, for example) closer to the initial value of the count value than the first threshold value to the initial value. A difference between the maximum storage quantity and the second threshold value is equivalent to the quantity of ink stored in the corresponding ink chamber 111 when the level of ink in the ink chamber 111 is aligned with the second line 147, for example.

In the following description, a state of the ink chamber 111 when the difference between the first threshold value and the corresponding count value (first threshold value−count value) is less than 0 will be referred to as a "soft-empty" state. Further, a state of the ink chamber 111 when the difference between the second threshold value and the corresponding count value (second threshold value−count value) is less than 0 will be referred to as an "ink low" state. Hence, the ink chamber 111 arrives at the ink low state prior to the soft-empty state. Ideally or theoretically, a timing at which the ink chamber 111 reaches the soft-empty state is equivalent to a timing at which the ink chamber 111 reaches the hard-empty state. The difference between the first threshold value and the count value and the difference between the second threshold value and the count value may be used as estimation values of the quantity of ink remaining in the corresponding ink chamber 111. "Soft-empty" is an example of the quantity of ink stored in the ink chamber 111 being less than the residual ink threshold.

Note that the count value, the first threshold value, and the second threshold value are not limited to the relationships described above. As an alternative example, the count value may be set to an initial value (100, for example) in S36, and may be decremented in S46 based on the quantity of ink ejected from the recording assembly 24. Here, the first threshold value may be set to a smaller value (5, for example) than the second threshold value (15, for example). In this variation, the soft-empty state is determined based on (count value−first threshold value), and the ink low state is determined based on (count value−second threshold value).

In other words, the count value should be updated in S46 in a direction approaching the first threshold value. Here, the expression "a direction approaching the first threshold value" represents the relationship between the count value and the first threshold value when the count value has been set to its initial value. That is, an incremented count value is continuously incremented, even after reaching the first threshold value. Similarly, a decremented count value is continuously decremented, even after reaching the first threshold value. Further, the second threshold value should be set to a value at which its difference with the count value reaches 0 before the difference between the count value and the first threshold value reaches 0.

Note that the difference between the first threshold value and the corresponding count value is obtained by subtracting one of the first threshold value and the count value from the other of the first threshold value and the count value. Further, the difference between the second threshold value and the corresponding count value is obtained by subtracting one of the second threshold value and the count value from the other of the second threshold value and the count value. In a case where the difference between the first threshold value and the correspond count value is obtained by subtracting the first threshold value from the count value, the difference between the second threshold value and the corresponding count value should be obtained by subtracting the second threshold value from the count value. In a case where the difference between the first threshold value and the corresponding count value is obtained by subtracting the count value from the first threshold value, the difference between the second threshold value and the corresponding count value should be obtained by subtracting the count value from the second threshold value. The difference between the first threshold value and the corresponding count value is an example of a first difference. The difference between the second threshold value and the corresponding count value is an example of a second difference.

The EEPROM 134 also stores a soft-empty flag and an ink low flag for each of the ink chambers 111B, 111Y, 111C, and 111M. The soft-empty flag is information indicating whether the corresponding ink chamber 111 is in the soft-empty state. The soft-empty flag is set to either a value "ON" corresponding to the soft-empty state or a value "OFF" corresponding to a non-soft-empty state. The ink low flag is information indicating whether the corresponding ink chamber 111 is in the ink low state. The ink low flag is set to either a value "ON" corresponding to the ink low state or a value "OFF" corresponding to a non-ink-low state.

The soft-empty flag is set to "ON" when the difference between the first threshold value and the corresponding count value is less than 0 in S46, for example, and is set to "OFF" in S36. The ink low flag is set to "ON" when the difference between the second threshold value and the corresponding count value is less than 0 in S46, for example, and is set to "OFF" in S36. The initial value of the soft-empty flag and the initial value of the ink low flag are both "OFF".

The EEPROM 134 also stores a hard-empty flag. The hard-empty flag is information indicating whether the ink chamber 111B entered the hard-empty state the last time ink was ejected from the recording assembly 24. The hard-empty flag is set to either a value "ON" corresponding to the hard-empty state or a value "OFF" corresponding to a non-hard-empty state. The hard-empty flag is set to "ON" during image recording in S45 described later when the residual ink signal outputted from the residual ink sensor 73 switches from the first residual ink signal to the second residual ink signal, for example, and is set to "OFF" in S36. The initial value of the hard-empty flag is "OFF".

In the following description, the soft-empty flag and the ink low flag corresponding to the ink chamber 111B will be referred to as the "soft-empty flag B" and the "ink low flag B," respectively; the soft-empty flag and the ink low flag corresponding to the ink chamber 111Y will be referred to as the "soft-empty flag Y" and the "ink low flag Y," respectively; the soft-empty flag and the ink low flag corresponding to the ink chamber 111C will be referred to as the "soft-empty flag C" and the "ink low flag C," respectively; the soft-empty flag and the ink low flag corresponding to the ink chamber 111M will be referred to as the "soft-empty flag M" and the "ink low flag M," respectively. The hard-empty flag indicates the state of the ink chamber 111B, since the residual ink sensor 73 and the ink detection portion 152 are only provided for the tank 100B. Hence, the soft-empty flag B may be omitted in this case.

The EEPROM 134 also stores a refill inference flag. The refill inference flag indicates results of inferring whether at least one of the ink chambers 111 has been refilled with ink. The refill inference flag is either set to "ON" (first value) when it is inferred that at least one of the ink chambers 111 has been refilled, or "OFF" (second value) when it is inferred that no ink chamber 111 has been refilled. The initial value of the refill inference flag is "OFF". The refill inference flag may be stored in the RAM 133.

Further, the conveyor 23, the recording assembly 24, the display 15, the communication interface 25, the operation interface 17, the cover sensor 72, and the residual ink sensor 73 are connected to the ASIC 135. In other words, the conveyor 23, the recording assembly 24, the display 15, the communication interface 25, the operation interface 17, the cover sensor 72, and the residual ink sensor 73 are electrically connected to the controller 130. The controller 130 controls the conveyor 23 to convey sheets, controls the recording assembly 24 to eject ink, controls the display 15 to display screens, and controls the communication interface 25 to communicate with external devices. Further, the controller 130 acquires operation signals from the operation interface 17, acquires position signals from the cover sensor 72, and acquires residual ink signals from the residual ink sensor 73. As an example, the controller 130 may read the position signal outputted from the cover sensor 72 and the residual ink signal outputted from the residual ink sensor 73 at prescribed time intervals (every 50 msec, for example).

The controller 130 also includes an internal clock (otherwise known as a hardware clock) that outputs time information. The internal clock is updated by electric power supplied from the external power source through the power supply 120 when the power supply 120 is in the plug ON state (i.e., in any of the switch OFF state, the switch ON state, the idle state, and the drive state). When the power supply 120 is in the plug OFF state, on the other hand, the internal clock is updated by electric power supplied from the internal power source 121. When the charge in the internal power source 121 is depleted, the time information outputted from the internal clock is reset to an initial value (a null value, for example).

<Operations of MFP 10>

Next, operations of the MFP 10 will be described with reference to FIGS. 6 through 8. The CPU 131 of the controller 130 performs all processes described in FIGS. 6 through 8. Note that, to implement the following processes, the CPU 131 may read and execute a program stored in the ROM 132. Alternatively, the following processes may be implemented by hardware circuits mounted in the controller 130.

<Cover Open Process>

Figure 6:
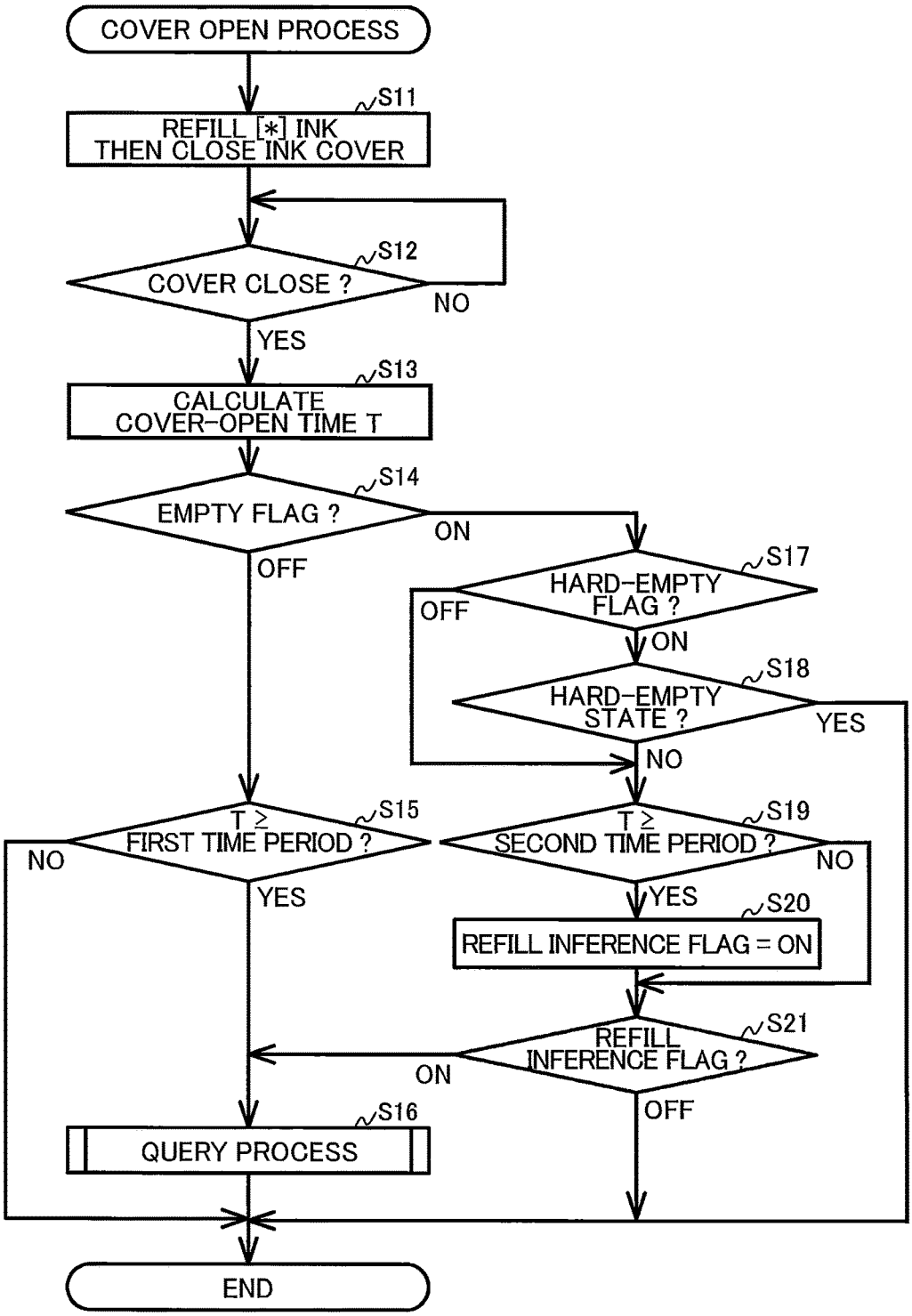
FIG. 6 is a flowchart illustrating steps in a cover open process performed by a controller 130 of the MFP 10.

First, the controller 130 detects the cover open event through the cover sensor 72 and performs a cover open process illustrated in FIG. 6 in response to the detection of the cover open event through the cover sensor 72. The controller 130 performs the cover open process in response to the movement of the cover 70 from its covering position to its exposing position while the MFP 10 is in a standby state (a state in which the MFP 10 is not performing an image recording process described later), for example. The cover open process is performed to prompt the user to refill an ink chamber 111 with ink and to confirm with the user that the ink chamber 111 has been refilled.

In S11 at the beginning of the cover open process in FIG. 6, the controller 130 controls the display 15 to display a refill notification screen on the display 15. A character string "REFILL [*] INK" and a character string "THEN CLOSE INK COVER" are alternately displayed in the refill notification screen, for example. Here, "[*]" is replaced with characters representing the colors of ink (Bk, Y, C, and M). The controller 130 may include, in the refill notification screen, characters representing the colors of ink stored in ink chambers 111 in the ink low state. The controller 130 controls the display 15 to continuously display the refill notification screen on the display 15 until the controller 130 detects the cover close event through the cover sensor 72 (S12: NO). In addition, the controller 130 acquires, from the internal clock, first time information indicative of time that the cover open event is detected and stores this first time information in the RAM 133.

When viewing the refill notification screen, the user removes the cap 113 from the inlet 112 of the ink chamber 111 to be refilled and injects ink into the ink chamber 111. After refilling the ink chamber 111, the user closes the inlet 112 with the cap 113 and moves the cover 70 back to the covering position. At this time, the user may refill ink of only those colors indicated in the refill notification screen, may refill ink of all colors, or may not refill ink of any color. However, the controller 130 cannot detect what colors of ink have been refilled.

In response to the detection of the cover close event through the cover sensor 72 (S12: YES), in S13 the controller 130 calculates a cover-open time T. The cover open time T is an example of an exposing time. The cover-open time T is a time interval during which the cover 70 has been in the exposing position. In other words, the cover-open time T is the time during which the cover sensor 72 has continuously outputted the second position signal. To calculate the cover-open time T, the controller 130 acquires, from the internal clock, second time information indicative of time that the cover close event is detected and subtracts the time indicated by the second time information from the time indicated by the first time information, for example.

Next, in S14 the controller 130 determines the settings for the hard-empty flag and the soft-empty flags Y, C, and M. Specifically, the controller 130 determines whether at least one of the hard-empty flag and the soft-empty flags Y, C, and M has been set to "ON" (S14: ON) or whether all of the hard-empty flag and the soft-empty flags Y, C, and M have been set to "OFF" (S14: OFF). Note that the settings for the hard-empty flag and the soft-empty flags Y, C, and M are never updated while the cover 70 is in the exposing position. The process in S14 is an example of a first determination process for determining whether any ink chamber 111 is in an empty state at the time of opening the cover 70.

In response to the determination that all of the hard-empty flag and the soft-empty flags Y, C, and M have been set to "OFF" (S14: OFF), in S15 the controller 130 determines whether the cover-open time T calculated in S13 is greater than or equal to a first time period. The first time period is a preset period of time thought to be necessary for a typical user to inject ink into an ink chamber 111, for example. The process in S15 is an example of a second determination process. In response to the determination that the cover-open time T is greater than or equal to the first time period (S15: YES), in S16 the controller 130 performs a query process described later. However, in response to the determination that the cover-open time T is less than the first time period (S15: NO), the controller 130 ends the cover open process without performing the query process of S16.

However, in response to the determination that at least one of the hard-empty flag and the soft-empty flags Y, C, and M has been set to "ON" (S14: ON), in S17 the controller 130 determines the setting for the hard-empty flag. In response to the determination that the hard-empty flag has been set to "ON" (S17: ON), in S18 the controller 130 determines whether the residual ink signal outputted from the residual ink sensor 73 at the current point in time indicates the hard-empty state. In response to the determination that the residual ink signal does not indicate the hard-empty state at the current point in time (S18: NO), the controller 130 performs a process from S19. However, in response to the determination that the residual ink signal indicates the hard-empty state at the current point in time (S18: YES), the controller 130 ends the cover open process without performing the process in S19-S21. In addition, in response to the determination that the hard-empty flag has been set to "OFF" but that at least one of the soft-empty flags Y, C, and M has been set to "ON" (S17: OFF), then the controller 130 skips S18 and performs the process from S19.

In S19 the controller 130 determines whether the cover-open time T calculated in S13 is greater than or equal to a second time period. The second time period may be set to a period of time the same as or different from the first time period. The process in S19 is an example of a third determination process. In response to the determination that the cover-open time T is greater than or equal to the second time period (S19: YES), in S20 the controller 130 sets the refill inference flag to "ON". The process in S20 is an example of a first setting process. However, in response to determination that the cover-open time T is less than the second time period (S19: NO), the controller 130 skips S20 and advances to S21.

Here, there are two possibilities for the refill inference flag being set to "ON". First, the refill inference flag may have been set to "ON" in S20 of the current cover open process. Secondly, the refill inference flag may have been set to "ON" in S20 of a previous cover open process but has not yet been reset to "OFF" in S37 described later. Thus, although there is a possibility that the ink chamber 111 has been refilled with ink, the count value for the ink chamber 111 has not been initialized when the refill inference flag is set to "ON". When the refill inference flag is set to "OFF", on the other hand, it is either highly likely that the ink chamber 111 has not been refilled or the count value has been initialized.

Next, the controller 130 determines the setting for the refill inference flag in S21. In response to the determination in S21 that the refill inference flag has been set to "ON" (S21: ON), in S16 the controller 130 performs the query process. However, in response to the determination that the refill inference flag has been set to "OFF" (S21: OFF), the controller 130 ends the cover open process without performing the query process of S16.

The query process is performed to prompt the user to confirm whether the ink chambers 111 have been refilled with ink and to initialize the corresponding count values for the ink chambers 111 based on the user's response. Next, the query process will be described in detail with reference to FIG. 7.

<Query Process>

Figure 7:
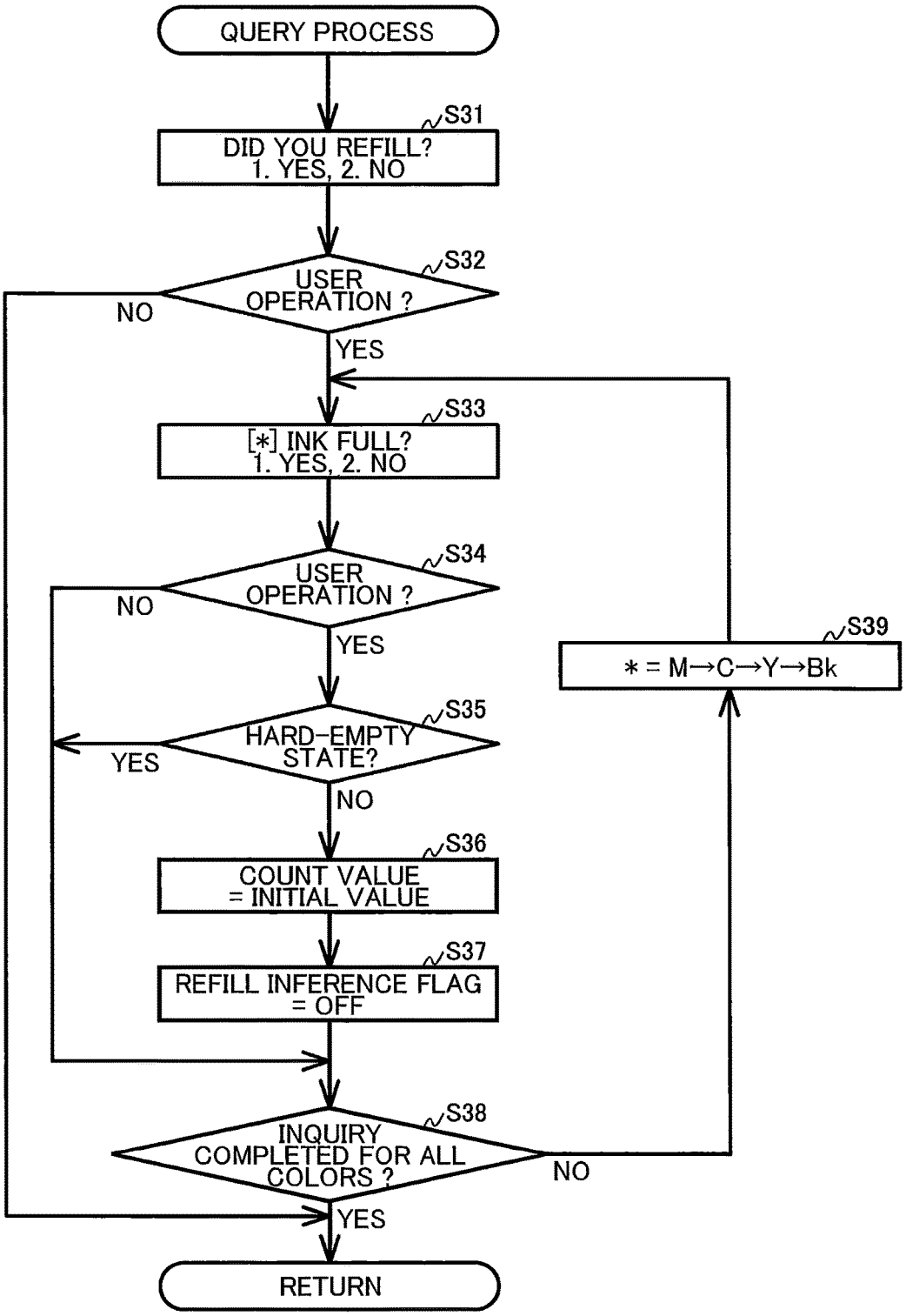
FIG. 7 is a flowchart illustrating steps in a query process performed by the controller 130.

In S31 at the beginning of FIG. 7, the controller 130 controls the display 15 to display a preliminary inquiry screen on the display 15. The preliminary inquiry screen prompts the user to indicate whether at least one of the ink chambers 111 has been refilled. For example, a character string "DID YOU REFILL?" and a character string "1. YES, 2. NO" are alternately displayed in the preliminary inquiry screen. The controller 130 controls the display 15 to continuously display the preliminary inquiry screen on the display 15 until the controller 130 receives a third operation or a fourth operation through the operation interface 17 (S32).

The third operation is a user operation for indicating that at least one of the ink chambers 111 has been refilled with ink and corresponds to pressing the [1] button, for example. The fourth operation is a user operation for indicating that none of the ink chambers 111 have been refilled with ink and corresponds to pressing the [2] button, for example. The process in S31 and S32 is an example of a preliminary inquiry process.

In response to the pressing of the [1] button while the preliminary inquiry screen is displayed (S32: YES), in S33 the controller 130 controls the display 15 to display an inquiry screen on the display 15 that targets the ink chamber 111M. This inquiry screen prompts the user to indicate whether the ink chamber 111M has been refilled with ink up to its maximum storage quantity. For example, a character string "M INK FULL?" and a character string "1. YES, 2. NO" are alternately displayed in the inquiry screen. The controller 130 controls the display 15 to continuously display the inquiry screen on the display 15 until the controller 130 receives a first operation or a second operation through the operation interface 17 (S34).

The first operation is a user operation for indicating that the ink chamber 111M has been refilled with ink up to the level of its maximum storage quantity and corresponds to pressing the [1] button, for example. The second operation is a user operation either for indicating that the ink chamber 111M has been refilled with ink but not up to the level of its maximum storage quantity in a case where, of the ink chambers 111, the ink chamber 111M has been refilled and the [1] button is pressed in S32, or for indicating that the ink chamber 111M has not been refilled in a case where the [1] button is pressed in S32 but any of the ink chambers 111 other than the ink chamber 111M has been refilled. The second operation corresponds to pressing the [2] button, for example.

Note that the first operation and the third operation may correspond to pressing the same button or may correspond to pressing different buttons. This is also true for the second operation and the fourth operation. The process in S33 and S34 is an example of an inquiry process.

In response to the pressing of the [1] button while the inquiry screen targeting the ink chamber 111M is displayed (S34: YES), the controller 130 skips the process in S35 and advances to S36. In S36 the controller 130 sets the count value M to an initial value (0) and advances to S37. In S37 the controller 130 sets the soft-empty flag M and the ink low flag M to "OFF", and also sets the refill inference flag to "OFF". The process in S36 is an example of an initialization process, and the process in S37 is an example of a second setting process. However, in response to the pressing of the [2] button while the inquiry screen targeting the ink chamber 111M is displayed (S34: NO), then the controller 130 advances to S38 without performing the process in S35-S37.

In S38 the controller 130 determines whether the process in S33-S37 has been completed for all colors. While the process in S33-S37 has not been performed for all colors (S38: NO), in S39 the controller 130 sets the target color to the next color in the sequence M→C→Y→Bk. In this way, the process in S33-S37 is repeated for each of the ink chambers 111M, 111C, 111Y, and 111B. While repeating the process in S33-S37, the controller 130 initializes the count value, the soft-empty flag, and the ink low flag for the corresponding ink chamber 111 in response to the pressing of the [1] button, but does not initialize these values in response to the pressing of the [2] button. In addition, while repeating the process in S33-S37, the controller 130 initializes the refill inference flag when the [1] button is pressed even once, but does not initialize the refill inference flag when the [1] button is never pressed.

Further, when performing the process in S33-S37 targeting the ink chamber 111B, the controller 130 advances to S35 in response to the pressing of the [1] button while the inquiry screen is displayed (S34: YES). In S35 the controller 130 determines whether the ink chamber 111B is in the hard-empty state at the current point in time. In response to the determination that the ink chamber 111B is not in the hard-empty state at the current point in time (S35: NO), in S36 and S37 the controller 130 initializes the count value B, the hard-empty flag, the soft-empty flag B, the ink low flag B, and the refill inference flag. However, in response to the determination that the ink chamber 111B is in the hard-empty state at the current point in time (S35: YES), the controller 130 advances to S38 without performing the process in S36 and S37.

After the controller 130 has completed the process in S33-S37 for all the ink chambers 111 (S38: YES), the controller 130 ends the query process. Note that the sequence in which the controller 130 performs the process in S33-S37 for the ink chambers 111M, 111C, 111Y, and 111B is not limited to the above example.

Further, in response to the pressing of the [2] button while the preliminary inquiry screen is displayed (S32: NO), the controller 130 ends the query process without performing the process in S33-S39 even one time.

<Image Recording Process>

Next, an image recording process will be described with reference to FIG. 8. The controller 130 performs the image recording process based on a recording instruction that is inputted into the MFP 10. The recording instruction is an instruction to the MFP 10 to perform a recording process for recording images on sheets based on image data. While there is no particular limitation on the source for acquiring the recording instruction, the recording instruction may be acquired from the user through the operation interface 17 or may be acquired from an external device through the communication interface 25, for example. In addition, the recording instruction may instruct the MFP 10 to record images on sheets based on fax data.

Figure 8:
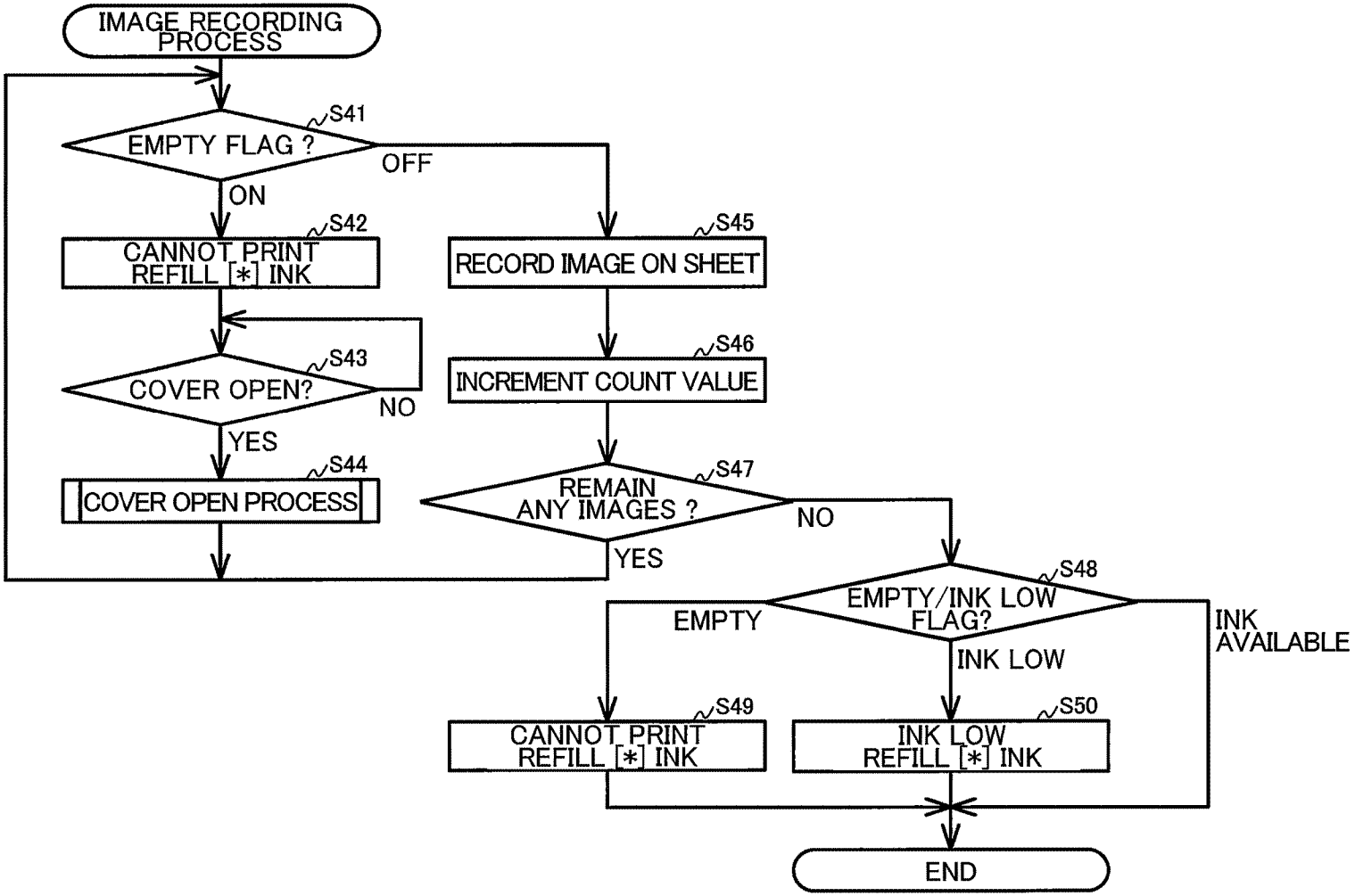
FIG. 8 is a flowchart illustrating steps in an image recording process performed by the controller 130.

In S41 at the beginning of the image recording process in FIG. 8, the controller 130 determines the settings for the hard-empty flag and the soft-empty flags Y, C, and M. The process in S41 is an example of a fourth determination process. Specifically, the controller 130 determines whether at least one of the hard-empty flag and the soft-empty flags Y, C, and M has been set to "ON" (S41: ON) or whether all of the hard-empty flag and the soft-empty flags Y, C, and M have been set to "OFF" (S41: OFF). In response to the determination that any one of the hard-empty flag and the soft-empty flags Y, C, and M has been set to "ON" (S41: ON), in S42 the controller 130 controls the display 15 to display an empty notification screen on the display 15. The empty notification screen is an example of a notification screen for notifying the user that the recording process cannot be performed until ink has been refilled. The process in S42 is an example of a notification process.

More specifically, a character string "CANNOT PRINT" and a character string "REFILL [*] INK" are alternately displayed in the empty notification screen. Here, "[*]" is replaced with characters representing the colors of ink stored in ink chambers 111 whose corresponding hard-empty flag and soft-empty flags Y, C, and M have been set to "ON". The controller 130 controls the display 15 to continuously display the empty notification screen on the display 15 until the controller 130 detects the cover open event through the cover sensor 72 (S43: NO). In response to the detection of the cover open event through the cover sensor 72 (S43: YES), in S44 the controller 130 performs the cover open process. After completing the cover open process, the controller 130 repeats the process from S41.

When any one of the hard-empty flag and the soft-empty flags Y, C, and M has been still set to "ON" after performing the cover open process (S41: ON), the controller 130 repeats the process from S42 described above.

On the other hand, in response to the determination that all of the hard-empty flag and the soft-empty flags Y, C, and M have been set to "OFF" (S41: OFF), in S45 the controller 130 records images on sheets based on image data included in the recording instruction. The process in S45 is an example of a recording process. Thus, the recording assembly 24 ejects ink when all of the hard-empty flag and the soft-empty flags Y, C, and M have been set to "OFF", but does not eject ink when even one of the hard-empty flag and the soft-empty flags Y, C, and M has been set to "ON".

More specifically, in S45 the controller 130 controls the conveyor 23 to convey a sheet supported in the feed tray 20 to a position confronting the recording assembly 24. Next, the controller 130 controls the recording assembly 24 to eject ink toward the sheet confronting the recording assembly 24 to record an image on the sheet. Subsequently, the controller 130 controls the conveyor 23 to discharge the sheet having an image recorded by the recording assembly 24 into the discharge tray 21.

In addition, in S46 the controller 130 counts the quantity of ink ejected from the recording assembly 24 in S45 for each color and increments the corresponding count value. The process in S46 is an example of an updating process. Note that the timing for incrementing the count values is not limited to the timing of S46. Any time ink is ejected from the recording assembly 24, the controller 130 increments the corresponding count values based on the quantities of ink ejected from the recording assembly 24, such as in a flushing process in which the recording assembly 24 ejects ink toward an ink receptor (not illustrated) or a purging process in which a pump or the like (not illustrated) forcibly discharges ink from the recording assembly 24.

Here, the controller 130 sets the hard-empty flag to "ON" when the residual ink signal outputted from the residual ink sensor 73 switches from the first residual ink signal to the second residual ink signal while the recording assembly 24 ejects ink. Further, when the difference between any count value and the corresponding second threshold value becomes less than 0 while the count values are incremented, the controller 130 sets the corresponding ink low flag to "ON". Further, when the difference between any count value and the corresponding first threshold value becomes less than 0 while the count values are incremented, the controller 130 sets the corresponding soft-empty flag to "ON".

In S47 the controller 130 determines whether there remain any images indicated in the recording instruction that have not been recorded on sheets. Until all images indicated in the recording instruction are recorded on sheets (S47: YES), the controller 130 returns to S41 and repeats the process in S41-S46 described above. After all images indicated in the recording instruction have been recorded on sheets (S47: NO), in S48 the controller 130 determines the settings for the hard-empty flag, the soft-empty flags Y, C, and M, and the ink low flags B, Y, C, and M.

In response to the determination that any one of the hard-empty flag and the soft-empty flags Y, C, and M has been set to "ON" (S48: Empty), in S49 the controller 130 controls the display 15 to display the empty notification screen on the display 15. However, in response to the determination that all of the hard-empty flag and the soft-empty flags Y, C, and M have been set to "OFF" but any one of the ink low flags B, Y, C, and M has been set to "ON" (S48: Ink Low), in S50 the controller 130 controls the display 15 to display an ink low notification screen on the display 15. On the other hand, in response to the determination that all of the hard-empty flag, the soft-empty flags Y, C, and M, and the ink low flags B, Y, C, and M have been set to "OFF" (S48: Ink Available), the controller 130 ends the image recording process without performing any of the process in S49 or S50.

The empty notification screen displayed in S49 may be identical to that displayed in S42. The ink low notification screen is a notification screen for notifying the user that the ink chamber 111 is approaching the soft-empty state. Specifically, a character string "INK LOW" and a character string "REFILL [*] INK" are alternately displayed in the ink low notification screen. Here, "[*]" is replaced with characters representing the colors of ink stored in ink chambers 111 in the ink low state.

The controller 130 controls the display 15 to continuously display the empty notification screen or the ink low notification screen on the display 15 until one of the following events occurs: the cover open event is detected through the cover sensor 72, the recording instruction is inputted, the operation interface 17 is operated, or the state of the power supply 120 changes to a state other than the drive state (i.e., the idle state, the switch OFF state, or the plug OFF state).

<Operational Advantages>

In the disclosure described above, if the cover 70 is opened and closed while at least one of the hard-empty flag and the soft-empty flags Y, C, and M has been set to "ON", the controller 130 performs the query process, regardless of the current cover-open time T. In this way, if the user inadvertently performs an incorrect operation in the query process immediately after refilling ink, the user can repeat the query process simply by momentarily opening and closing the cover 70. If all of the hard-empty flag and the soft-empty flags Y, C, and M have been set to "OFF", on the other hand, the controller 130 determine the need for the query process based on the cover-open time T as in the previous manner, thereby avoiding unnecessarily performing query processes.

If the hard-empty flag has been set to "ON" but the ink chamber 111B is not in the hard-empty state at the time of performing the process in S18 immediately after the cover 70 has been opened and closed (S17: ON and S18: NO), it is conceivable that the controller 130 did not initialize the count value after the cover 70 was opened and closed the previous time, despite the ink chamber 111B being refilled with ink. That is, there is a possibility that the user performed an incorrect operation in the query process immediately after refilling the ink chamber 111B the previous time the cover 70 was opened and closed. Therefore, it is desirable to repeat the query process in this case, regardless of the cover-open time T.

On the other hand, if the hard-empty flag has been set to "ON" and the ink chamber 111B is in the hard-empty state at the time the controller 130 performs the process of S18 (S17: ON; S18: YES), it is likely that the ink chamber 111B has not been refilled. Performing the query process in this case would not only increase the user's burden of performing operations, but could also potentially lead to the count value being initialized due to an incorrect operation performed by the user, resulting in the recording assembly 24 ejecting ink despite the ink chamber 111B actually being in the hard-empty state. This would give rise to a new problem in which air is introduced into the channel leading from the ink chamber 111B to the recording assembly 24 when the recording assembly 24 ejects ink after the level of ink drops below the interior space of the ink supply port 151, adversely affecting the image recording quality. Hence, it is preferable not to perform the query process in this case.

Further, if the refill inference flag has been set to "ON", the cover 70 has remained continuously in the exposing position for at least the second time period after one of the hard-empty flag and the soft-empty flags Y, C, and M has been set to "ON". In other words, if one of the hard-empty flag and the soft-empty flags Y, C, and M has been set to "ON" and the refill inference flag has been set to "ON" (S14: ON and S21: ON), then it is possible that the user performed an incorrect operation during the query process despite having refilled the ink chamber 111 whose corresponding flag has been set to "ON" prior to the query process.

Therefore, if it is conceivable that this type of erroneous operation has occurred, then it is desirable to perform the query process unconditionally the next time the cover 70 is opened and closed, regardless of the cover-open time T. On the other hand, if one of the hard-empty flag and the soft-empty flags Y, C, and M has been set to "ON" but the refill inference flag has been set to "OFF" (S14: ON and S21: OFF), then there is a high probability that the ink chamber 111 has not been refilled. Therefore, it is preferable in this case not to perform the query process to avoid increasing the user's burden of performing operations and the potential for air introduction. Incidentally, the problem addressed in the present disclosure can be solved even when the processes S19-S21 and S37 are omitted.

With the MFP 10 provided with a plurality of ink chambers 111B, 111Y, 111C, and 111M, the user must repeatedly perform operations while checking the inquiry screen to input one of the first operation and the second operation for each of the ink chambers 111. Hence, by performing the query process only when necessary, the MFP 10 can avoid increasing the user's burden of performing operations and the potential for air introduction. Further, the user can avoid having the query process performed repeatedly for each ink chamber 111 by performing the fourth operation in the preliminary inquiry screen. In this way, the MFP 10 can avoid an increase in the user's burden of performing operations and the potential for air introduction when the cover 70 is opened and closed for a purpose other than injecting ink, for example.

In the embodiment described above, once one of the hard-empty flag and the soft-empty flags Y, C, and M becomes set to "ON", the controller 130 does not perform the recording process until the corresponding ink chamber 111 is refilled with ink and the relevant count value, hard-empty flag, and soft-empty flags Y, C, and M are initialized. However, by employing the above process, the user can be given another opportunity to initialize the count value, the hard-empty flag, and the soft-empty flags Y, C, and M after performing an incorrect operation in the query process performed immediately after ink is refilled, simply by opening and closing the cover 70 momentarily.

Further, the MFP 10 is configured so that the user can visually recognize the level of ink in the ink chambers 111 from outside the ink tank 100. Accordingly, if the user notices that the level of ink is low in an ink chamber 111, the user can move the cover 70 to the exposing position and inject ink into the relevant ink chamber 111 through the corresponding inlet 112.

The first time period in S15 may be adjusted (i.e. increased or decreased) based on whether the ink chamber 111 is in the ink low state. In other words, the first time period may be set longer for an ink chamber 111 that is in the ink low state than for an ink chamber 111 that is not in the ink low state. More specifically, the first time period may be set to a longer time interval when the number of ink chambers 111 in the ink low state is greater, i.e., when there are a greater number of ink low flags set to "ON".

By adjusting the first time period based on the difference between the second threshold value and the count value in this way, the controller 130 can determine more appropriately whether to perform the query process. For example, the probability of the user refilling the ink chamber 111 with ink is higher when the difference between the second threshold value and the count value is smaller, and lower when the difference between the second threshold value and the count value is greater. Hence, the controller 130 can avoid unnecessary query process by increasing the first time period when the difference between the second threshold value and the count value is greater.

It is also possible that the user will refill multiple ink chambers 111 with ink after moving the cover 70 to the exposing position. In such cases, the length of time required to refill the ink chambers 111 with ink is likely greater when the number of ink chambers 111 in the ink low state is greater. Hence, adjusting the first time period based on the number of ink low flags set to "ON" will improve the precision for inferring whether ink chambers 111 have been refilled.

Similarly, the second time period in S19 may be set to a longer time interval when the number of ink chambers 111 in the empty state is greater, i.e., when there are a greater number of flags among the hard-empty flag and the soft-empty flags Y, C, and M that have been set to "ON". It is possible that the user will refill multiple ink chambers 111 with ink after moving the cover 70 to the exposing position. In such cases, the length of time required to refill the ink chambers 111 with ink is likely greater when the number of ink chambers 111 in the empty state is higher. Hence, adjusting the second time period based on the number of flags among the hard-empty flag and the soft-empty flags Y, C, and M set to "ON" will improve the precision for inferring whether ink chambers 111 have been refilled.

While the process in the embodiment described above performs both the process in S18 and the process in S35, one of the process in S18 and the process in S35 may be omitted. Further, while the present embodiment describes an example of skipping the process in S18 when one of the soft-empty flags Y, C, and M has been set to "ON", the controller 130 may instead skip the process in S19-S21 when one of the soft-empty flags Y, C, and M has been set to "ON" and the ink chamber 111B is in the hard-empty state at the timing that the controller 130 performs S18. If the ink chamber 111B is in the hard-empty state at the timing that the controller 130 performs S18, then the ink chamber 111B has not been refilled even though the cover 70 has been opened and closed. In such cases, it is highly likely that the user has not been refilled the other ink chambers 111Y, 111C, and 111M.

The present embodiment describes an example in which the ink detection portion 152 and the residual ink sensor 73 are only provided for the tank 100B. However, the ink detection portion 152 and the residual ink sensor 73 may be provided for each of the tanks 100B, 100Y, 100C, and 100M or for none of the tanks 100B, 100Y, 100C, and 100M. When the ink detection portions 152 and the residual ink sensors 73 are provided for all of the tanks 100B, 100Y, 100C, and 100M, the controller 130 may skip S17 and in S18 the controller 130 may determine the residual ink signals from the residual ink sensors 73 whose corresponding hard-empty flag and soft-empty flags Y, C, and M have been set to "ON", and in S35 the controller 130 may determine the residual ink signals from the residual ink sensors 73 corresponding to the ink chambers 111 targeted in the corresponding process S33-S37. On the other hand, if the ink detection portion 152 and the residual ink sensor 73 are not provided for any of the ink chambers 111, the processes in S17, S18 and S35 may be omitted.

Note that if the process in S19-S21 is omitted, the controller 130 may be configured to perform the query process of S16 in response to the determination that the ink chamber 111B is not in the hard-empty state at the time of performing the process in S18 (S18: NO). Alternatively, if the process of S17 and S18 is omitted, then the controller 130 may be configured to perform the process from S19 in response to the determination that at least one of the hard-empty flag and the soft-empty flags Y, C, and M has been set to "ON" (S14: ON). If the process in S17-S21 is omitted, the controller 130 may be configured to perform the query process of S16 in response to determination that at least one of the hard-empty flag and the soft-empty flags Y, C, and M has been set to "ON" (S14: ON).

In the embodiment described above, the controller 130 determines the settings for the hard-empty flag, the soft-empty flags Y, C, and M, and the ink low flags B, Y, C, and M in steps S14, S41, and S48. However, the specific method of determination in S14, S41, and S48 is not limited to the above example. For example, when the ink detection portion 152 and the residual ink sensor 73 are provided for each of the tanks 100B, 100Y, 100C, and 100M, in S14, S41, and S48 the controller 130 may employ hard-empty flags Y, C, and M in place of the soft-empty flags Y, C, and M. However, when the ink detection portion 152 and the residual ink sensor 73 are not provided for any of the tanks 100B, 100Y, 100C, and 100M, in S14, S41, and S48, the controller 130 may employ a soft-empty flag B in place of the hard-empty flag.

As another variation, rather than determining the settings of the flags in S14, S41, and S48, the controller 130 may determine whether the ink chambers 111 are in the hard-empty state, the soft-empty state, or the ink low state. Specifically, in S14, S41, and S48 the controller 130 may determine whether the difference between the count value and either the first threshold value or the second threshold value is greater than or equal to 0 for each of the ink chambers 111B, 111Y, 111C, and 111M. The controller 130 may also store in the RAM 133 the residual ink signal outputted from the residual ink sensor 73 at the timing that the controller 130 detects the cover open event through the cover sensor 72. Subsequently, the controller 130 may determine in S14 whether the residual ink signal stored in the RAM 133 is the first residual ink signal (S14: OFF) or the second residual ink signal (S14: ON). Similarly, the controller 130 may determine in S41 whether the residual ink signal outputted from the residual ink sensor 73 is the first residual ink signal (S41: OFF) or the second residual ink signal (S41: ON).

While the description has been made in detail with reference to the embodiment(s) thereof, it would be apparent to those skilled in the art that many modifications and variations may be made therein without departing from the spirit of the disclosure.

What is claimed is:

1. An inkjet recording apparatus comprising:

a tank having a set of an ink chamber and an inlet;

a recording assembly including a recording head and configured to eject the ink stored in the ink chamber to record an image on a sheet;

a cover movable between a covering position covering the inlet to restrict ink from being injected into the ink chamber through the inlet and an exposing position exposing the inlet to an outside to allow ink to be injected into the ink chamber through the inlet;

a cover sensor configured to detect a position of the cover;

a memory configured to store:

a first threshold value; and a count value updated in a direction approaching the first threshold value in accordance with ejection of the ink from the recording assembly;

a display;

an operation interface; and a controller configured to control the recording head and the display, the controller being configured to:

perform, in response to the detection through the cover sensor that the cover has been moved to the exposing position and then moved to the covering position, a first determination process to determine whether a quantity of the ink stored in the ink chamber at a time the cover is moved to the exposing position is less than a residual ink threshold;

perform, in response to the determination in the first determination process that the quantity of the ink stored in the ink chamber is not less than the residual ink threshold, a second determination process to determine whether an exposing time during which the cover has been in the exposing position is not less than a first time period;

perform, based on the determination in the second determination process that the exposing time is not less than the first time period, an inquiry process to display an inquiry screen on the display and to receive one of a first operation and a second operation through the operation interface, the inquiry screen inquiring whether ink has been injected into the ink chamber;

perform, based on the determination in the first determination process that the quantity of the ink stored in the ink chamber is less than the residual ink threshold, the inquiry process without performing the second determination process; and perform, in response to the receipt of the first operation in the inquiry process, an initialization process to initialize the count value.

2. The inkjet recording apparatus according to claim 1, further comprising a residual ink sensor configured to detect whether a level of the ink stored in the ink chamber is higher than or equal to a detection position, wherein the recording assembly is configured to eject the ink stored in the ink chamber in a case where the quantity of the ink stored in the ink chamber is not less than the residual ink threshold and not to eject the ink stored in the ink chamber in a case where the quantity of the ink stored in the ink chamber is less than the residual ink threshold, wherein the controller is configured to perform, based on the determination in the first determination process that the quantity of the ink stored in the ink chamber is less than the residual ink threshold and the detection through the residual ink sensor that the level of the ink stored in the ink chamber is higher than or equal to the detection position, the inquiry process, and wherein the controller is configured not to perform, based on the determination in the first determination process that the quantity of the ink stored in the ink chamber is less than the residual ink threshold and the detection through the residual ink sensor that the level of the ink stored in the ink chamber is not higher than or equal to the detection position, the second determination process and the inquiry process.

3. The inkjet recording apparatus according to claim 2, wherein the first threshold value and the count value produce a first difference therebetween, the first difference being obtained by subtracting one of the first threshold value and the count value from the other of the first threshold value and the count value, the first difference corresponding to the quantity of the ink stored in the ink chamber and being variable as the count value is updated, wherein the memory is configured to further store a second threshold value, the second threshold value and the count value producing a second difference therebetween, the second difference being obtained by subtracting the second threshold value from the count value in a case where the first difference is obtained by subtracting the first threshold value from the count value and by subtracting the count value from the second threshold value in a case where the first difference is obtained by subtracting the count value from the first threshold value, the second difference corresponding to the quantity of the ink stored in the ink chamber and being variable as the count value is updated, the second difference reaching zero before the first difference reaches zero, and wherein the controller is configured to adjust a length of the first time period in the second determination process based on a value of the second difference.

4. The inkjet recording apparatus according to claim 3, wherein the controller is configured to set, in the second determination process, the length of the first time period to a longer value in a case where the second difference is not less than zero than in a case where the second difference is less than zero.

5. The inkjet recording apparatus according to claim 3, wherein the tank includes a plurality of the sets of an ink chamber and an inlet, wherein the memory is configured to store the count value for each of a plurality of ink chambers in the plurality of the sets, and wherein the controller is configured to increase the length of the first time period in the second determination process in accordance with an increase in number of the count values whose differences with the second threshold value are less than zero.

6. The inkjet recording apparatus according to claim 1, wherein the memory is configured to further store a refill inference flag, wherein the controller is configured to further:

perform, in response to the determination in the first determination process that the quantity of the ink stored in the ink chamber is less than the residual ink threshold, a third determination process to determine whether the exposing time is not less than a second time period; and perform, in response to the determination in the third determination process that the exposing time is not less than the second time period, a first setting process to set the refill inference flag to a first value, wherein the controller is configured not to perform, in response to the determination in the third determination process that the exposing time is less than the second time period, the first setting process, wherein the controller is configured to further perform, in response to the receipt of the first operation in the inquiry process, a second setting process to set the refill inference flag to a second value, wherein the controller is configured to perform, based on the determination in the first determination process that the quantity of the ink stored in the ink chamber is less than the residual ink threshold and the refill inference flag that has been set to the first value, the inquiry process, and wherein the controller is configured not to perform, based on the determination in the first determination process that the quantity of the ink stored in the ink chamber is less than the residual ink threshold and the refill inference flag that has been set to the second value, the second determination process and the inquiry process.

7. The inkjet recording apparatus according to claim 6, wherein the tank includes a plurality of the sets of an ink chamber and an inlet, wherein the memory is configured to store the count value for each of a plurality of ink chambers in the plurality of the sets, and wherein the controller is configured to:

perform, in response to the determination in the first determination process that the quantity of the ink stored in each of all the ink chambers is not less than the residual ink threshold, the second determination process; and perform, based on the determination in the first determination process that the quantity of the ink stored in at least one of the ink chambers is less than the residual ink threshold, the inquiry process without performing the second determination process, and wherein the controller is configured to increase the second time period in the third determination process in accordance with an increase in number of the ink chambers whose quantity of the ink stored therein is less than the residual ink threshold.

8. The inkjet recording apparatus according to claim 7, wherein the controller is configured to repeatedly perform the inquiry process for each of the plurality of ink chambers, wherein the controller is configured to initialize, in response to the receipt of the first operation in the inquiry process for a target ink chamber, the count value for the target ink chamber in the initialization process, and wherein the controller is configured not to initialize, in response to the receipt of the second operation in the inquiry process for the target ink chamber, the count value for the target ink chamber in the initialization process.

9. The inkjet recording apparatus according to claim 8, wherein the controller is configured to further perform, prior to performing the inquiry process, a preliminary inquiry process to display a preliminary inquiry screen on the display and to receive one of a third operation and a fourth operation through the operation interface, the preliminary inquiry screen inquiring whether ink has been injected into at least one of the plurality of ink chambers, wherein the controller is configured to perform, in response to the receipt of the third operation in the preliminary inquiry process, perform the inquiry process repeatedly for each of the plurality of ink chambers, the inquiry screen inquiring whether ink has been injected into the ink chamber up to a maximum storage quantity thereof, and wherein the controller is configured not to perform, in response to the receipt of the fourth operation in the preliminary inquiry process, the inquiry process.

10. The inkjet recording apparatus according to claim 1, wherein the controller is configured to further:

receive a recording instruction to record an image on a sheet;

perform, in response to the receipt of the recording instruction, a fourth determination process to determine whether the quantity of the ink stored in the ink chamber is less than the residual ink threshold;

perform, in response to the determination in the fourth determination process that the quantity of the ink stored in the ink chamber is not less than the residual ink threshold, a recording process to control the recording assembly to record an image on a sheet;

perform an updating process to update the count value based on the quantity of the ink ejected from the recording assembly in the recording process; and perform, in response to the determination in the fourth determination process that the quantity of the ink stored in the ink chamber is less than the residual ink threshold, a notification process to display a notification screen on the display without performing the recording process and the updating process, the notification screen notifying that an image cannot be recorded until ink is injected into the ink chamber.

11. The inkjet recording apparatus according to claim 1, wherein the tank has an outer surface, at least a part of the outer surface allowing the ink stored in the ink chamber to be visible from an outside of the tank.

* * * * *